US011707934B2

(12) United States Patent
Nukui et al.

(10) Patent No.: US 11,707,934 B2
(45) Date of Patent: Jul. 25, 2023

(54) PRINTING-FLUID CONTAINING DEVICE INCLUDING PRINTING-FLUID CARTRIDGE AND ADAPTOR

(71) Applicant: BROTHER KOGYO KABUSHIKI KAISHA, Nagoya (JP)

(72) Inventors: Kosuke Nukui, Nagoya (JP); Hiroaki Takahashi, Nagoya (JP); Toyonori Sasaki, Anjo (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/193,138

(22) Filed: Mar. 5, 2021

(65) Prior Publication Data

US 2021/0260883 A1 Aug. 26, 2021

Related U.S. Application Data

(63) Continuation of application No. 16/456,214, filed on Jun. 28, 2019, now Pat. No. 10,940,692, which is a (Continued)

(30) Foreign Application Priority Data

Sep. 30, 2016 (JP) ..... 2016-192575

(51) Int. Cl.
*B41J 2/17* (2006.01)
*B41J 2/175* (2006.01)

(52) U.S. Cl.
CPC ..... *B41J 2/17526* (2013.01); *B41J 2/1752* (2013.01); *B41J 2/17503* (2013.01); *B41J 2/17553* (2013.01); *B41J 2/17566* (2013.01)

(58) Field of Classification Search
None
See application file for complete search history.

(56) References Cited

U.S. PATENT DOCUMENTS

2004/0055487 A1 3/2004 Haan et al.
2004/0233258 A1* 11/2004 Kitabatake ..... F16K 15/145 347/85

(Continued)

FOREIGN PATENT DOCUMENTS

CN 102161279 A 8/2011
CN 102285239 A 12/2011

(Continued)

OTHER PUBLICATIONS

Extended European Search Report issued in related European Patent Application No. 17163927.1, dated Sep. 13, 2017.

(Continued)

*Primary Examiner* — Erica S Lin
(74) *Attorney, Agent, or Firm* — Merchant & Gould P.C.

(57) ABSTRACT

A printing-fluid containing device configured to be inserted into a cartridge attachment section in an insertion direction includes: a printing-fluid cartridge and an adaptor to which the cartridge is detachably assembled. The cartridge includes: a casing; a supply portion; a detection portion; and an engagement portion. The adaptor includes: an adaptor body; and an electrical interface. The detection portion includes a light accessible portion accessed by light from an outside of the cartridge. The engagement portion is engageable with the cartridge attachment section. The adaptor body has a front wall at its leading end in the insertion direction. The front wall has an opening through which the supply portion extends. The electrical interface is disposed on an outer surface of the adaptor body and electrically connectable to an electric contact of the cartridge attachment section.

16 Claims, 9 Drawing Sheets

Related U.S. Application Data continuation of application No. 15/473,898, filed on Mar. 30, 2017, now Pat. No. 10,350,899.

(56) References Cited

U.S. PATENT DOCUMENTS

| | | | |
|---|---|---|---|
| 2009/0237474 | A1 | 9/2009 | Ishizawa et al. |
| 2009/0322835 | A1 | 12/2009 | Kanbe et al. |
| 2013/0162733 | A1 | 6/2013 | Nakamura et al. |
| 2013/0258008 | A1 | 10/2013 | Kanbe et al. |
| 2013/0278684 | A1 | 10/2013 | Kanbe et al. |
| 2014/0055536 | A1 | 2/2014 | Takagi et al. |
| 2016/0089894 | A1 | 3/2016 | Ujita et al. |
| 2016/0279959 | A1* | 9/2016 | Okazaki ..... B41J 2/1752 |

FOREIGN PATENT DOCUMENTS

| | | | |
|---|---|---|---|
| CN | 202573285 | U | 12/2012 |
| CN | 203004524 | U | 6/2013 |
| CN | 103373076 | A | 10/2013 |
| CN | 203697707 | U | 7/2014 |
| CN | 105644154 | A | 6/2016 |
| EP | 1 400 358 | B1 | 9/2006 |
| EP | 2 505 363 | A3 | 11/2012 |
| EP | 2 644 386 | A2 | 2/2013 |
| EP | 2 653 315 | A2 | 10/2013 |
| EP | 2 743 086 | A2 | 6/2014 |
| JP | 2006159715 | A | 6/2006 |
| JP | 2009-132098 | A | 6/2009 |
| JP | 2013-212587 | A | 10/2013 |

OTHER PUBLICATIONS

Notification of First Office Action issued in corresponding Chinese Patent Application No. 201710397433.9, dated Mar. 20, 2020.

Office Action (Notice of Reasons for Refusal) issued in corresponding Japanese Patent Application No. 2016-192575, dated Sep. 23, 2020.

* cited by examiner

PRINTING-FLUID CONTAINING DEVICE INCLUDING PRINTING-FLUID CARTRIDGE AND ADAPTOR

CROSS REFERENCE TO RELATED APPLICATION

This application is a continuation of U.S. patent application Ser. No. 16/456,214, filed Jun. 28, 2019, now U.S. Pat. No. 10,940,692, which is a continuation of U.S. patent application Ser. No. 15/473,898, filed Mar. 30, 2017, now U.S. Pat. No. 10,350,899, which further claims priority from Japanese Patent Application No. 2016-192575 filed Sep. 30, 2016. The entire contents of the aforementioned applications are incorporated herein by reference.

TECHNICAL FIELD

The present disclosure relates to a printing-fluid containing device including a printing-fluid cartridge and an adaptor. The present disclosure also relates to a system for the printing-fluid containing device.

BACKGROUND

There are conventional image recording apparatuses known in the art that can record images on recording sheets by using ink. One such image recording apparatus includes an inkjet type recording head and is configured to selectively eject ink droplets from nozzles provided in the recording head, as disclosed in Japanese Patent Application Publication No. 2009-132098. As the ink droplets impact on the recording sheet, a desired image is recorded on the recording sheet. The image recording apparatus is provided with an ink cartridge that stores ink to be supplied to the recording head. The ink cartridge is attachable to and detachable from a cartridge attachment section of the image recording apparatus.

Japanese Patent Application Publication No. 2013-212587 discloses an ink cartridge that have an electronic component, such as a memory module, for storing data from which a color of ink, a material of ink, a remaining amount of ink, a maintenance condition, and the like are respectively determined. The memory module is electrically connected to an electric contact provided in the cartridge attachment section when the ink cartridge has been attached to the cartridge attachment section. Access to the memory module enables the data stored in the memory module to be retrieved therefrom.

SUMMARY

A configuration has been proposed in which an electronic component such as a memory module is provided at an adaptor and an ink cartridge is replaced by another while the adaptor remains in the cartridge attachment section. In this configuration, however, relative positions among the ink cartridge, the adaptor and, the cartridge attachment section are fixed by a friction force generated between the ink cartridge and the adaptor and a friction force generated between the adaptor and the cartridge attachment section since the ink cartridge and the adaptor are merely pushed into the cartridge attachment section. Consequently, a detection portion for detection of a remaining amount of ink in the ink cartridge and an electronic module are not stably fixed in position, which may cause inaccurate detection of the remaining amount of ink or may hinder retrieval of data stored in the electronic module.

In view of the foregoing, it is an object of the disclosure to provide a printing-fluid cartridge, an adaptor, and a cartridge attachment section that ensure the precision of positioning the printing-fluid cartridge, the adaptor, and the cartridge attachment section relative to one another.

In order to attain the above and other objects, according to one aspect, the disclosure provides a printing-fluid containing device configured to be inserted into a cartridge attachment section in an insertion direction to be detachably attached to the cartridge attachment section. The printing-fluid containing device includes: a printing-fluid cartridge and an adaptor. The printing-fluid cartridge includes: a casing; a supply portion; a detection portion; and an engagement portion. The adaptor to which the printing-fluid cartridge is configured to be detachably assembled includes: an adaptor body; and an electrical interface. The casing is configured to store printing-fluid therein. The supply portion is configured to allow the printing-fluid stored in the casing to flow out of the casing. The detection portion includes a light accessible portion configured to be accessed by light emitted from an outside of the printing-fluid cartridge. The engagement portion is configured to engage with the cartridge attachment section. The printing-fluid cartridge is insertable into the adaptor body. The adaptor body has a leading end and a trailing end in the insertion direction. The adaptor body has a front wall at the leading end. The front wall has an opening through which the supply portion extends. The adaptor body further has an outer surface. The electrical interface is disposed on the outer surface and electrically connectable to an electric contact provided at the cartridge attachment section.

According to another aspect, the disclosure provides an adaptor configured to be inserted into a cartridge attachment section in an insertion direction and accommodated in the cartridge attachment section together with a printing-fluid cartridge. The printing-fluid cartridge includes: a casing; a supply portion; a detection portion including a light accessible portion configured to be accessed by light emitted from an outside of the printing-fluid cartridge; and an engagement portion configured to engage with the cartridge attachment section. The adaptor includes: an adaptor body; and an electrical interface. The casing of the printing-fluid cartridge is inserted into the adaptor body. The adaptor body has a leading end and a trailing end in the insertion direction. The adaptor body has a front wall at the leading end and a top wall. The front wall has an opening through which the supply portion extends. The electrical interface is disposed on the top wall and electrically connectable to an electric contact provided at the cartridge attachment section.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Figure 1:
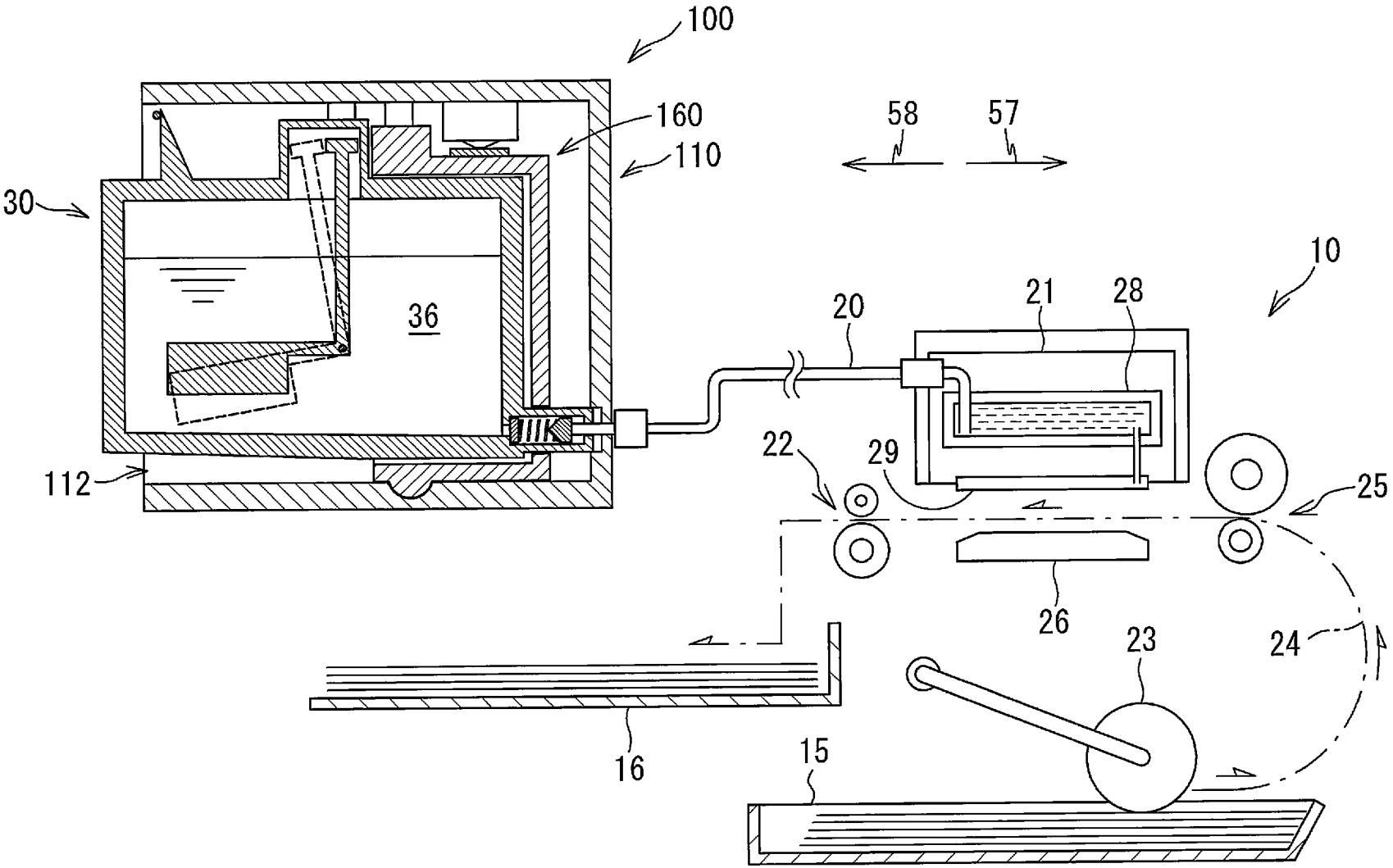
FIG. 1 is a schematic cross-sectional diagram illustrating an internal structure of a printer 10 provided with a cartridge attachment section 110 to which an ink cartridge 30 and an adaptor 160 according to one embodiment are detachably attached.

An ink cartridge 30 and an adaptor 160 according to one embodiment and a printer 10 configured to accommodate the ink cartridge 30 and the adaptor 160 therein will be described with reference to FIGS. 1 through 8, wherein like parts and components are designated by the same reference numerals to avoid duplicating description.

<Overview of Printer 10>

The printer 10 is configured to selectively eject ink droplets onto recording sheets to record images thereon based on an inkjet recording method. As illustrated in FIG. 1, the printer 10 includes an ink supply device 100. The ink supply device 100 includes a cartridge attachment section 110. A plurality of ink cartridges 30 (as an example of a printing-fluid cartridge) and a plurality of adaptors 160 are detachably attached to the cartridge attachment section 110. The cartridge attachment section 110 has, in one side thereof, an opening 112 that opens to an outside. The ink cartridges 30 and the adaptors 160 can be inserted into the cartridge attachment section 110 through the opening 112, and can be removed from the cartridge attachment section 110 through the opening 112. The ink cartridge 30 and the adaptor 160 constitute a printing-fluid containing device.

In the embodiment, four ink cartridges 30 corresponding to respective four colors of cyan, magenta, yellow, and black can be accommodated in the cartridge attachment section 110 of the ink supply device 100. Further, four adaptors 160 corresponding to the respective four ink cartridges 30 can also be accommodated in the cartridge attachment section 110 of the ink supply device 100. For an explanatory purpose, in the following description and the drawings, only one ink cartridge 30 and one adaptor 160 is assumed to be attached to the cartridge attachment section 110 unless otherwise specified.

Each of the ink cartridges 30 stores ink (an example of printing-fluid) that can be used in the printer 10. In a state where the ink cartridge 30 and the adaptor 160 are attached to the cartridge attachment section 110, the ink cartridge 30 and a recording head 21 are connected to each other by corresponding one of a plurality of ink tubes 20 (an example of a tube). The recording head 21 is provided with a plurality of sub-tanks 28 corresponding to the plurality of ink cartridges 30. Each sub-tank 28 is configured to temporarily store the ink supplied from the corresponding ink cartridge 30 through the corresponding ink tube 20. The recording head 21 is configured to selectively eject the ink supplied from the respective sub-tanks 28 through nozzles 29 according to an inkjet recording method.

The printer 10 further includes a sheet feeding tray 15, a sheet feeding roller 23, a pair of conveying rollers 25, a platen 26, a pair of discharge rollers 22, and a sheet discharge tray 16. The sheet feeding roller 23 feeds recording sheets from the sheet feeding tray 15 onto a conveying path 24, and the conveying rollers 25 convey the recording sheets over the platen 26. The recording head 21 selectively ejects ink onto the recording sheets as the recording sheets pass over the platen 26, whereby images are recorded on the recording sheets. The discharge rollers 22 receive the recording sheets that have passed over the platen 26 and discharge the recoding sheets onto the sheet discharge tray 16 provided at a position most downstream in the conveying path 24.

Figure 2:
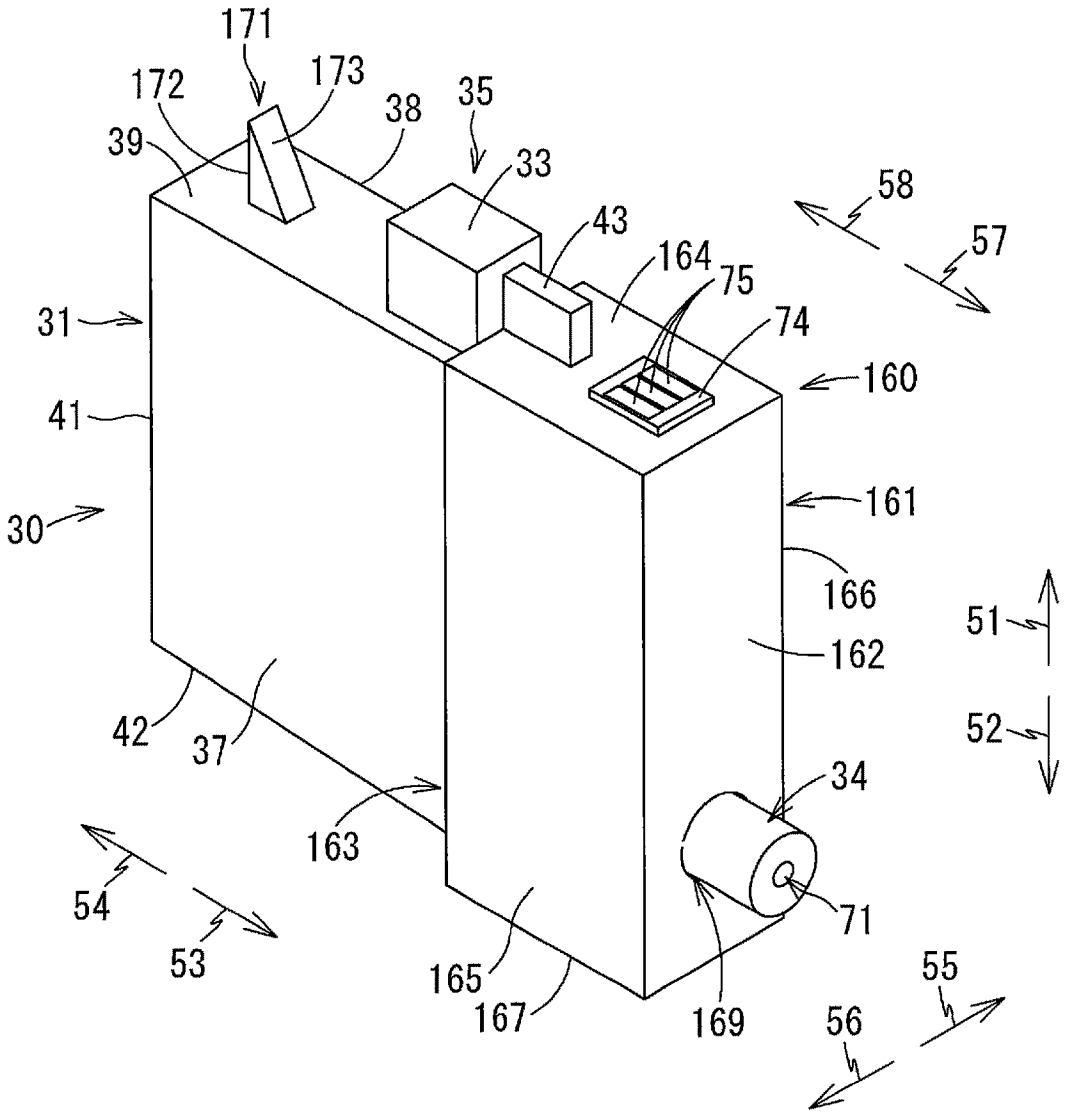
FIG. 2 is a perspective view illustrating an external configuration of the ink cartridge 30 and the adaptor 160 according to the embodiment.
Figure 6:
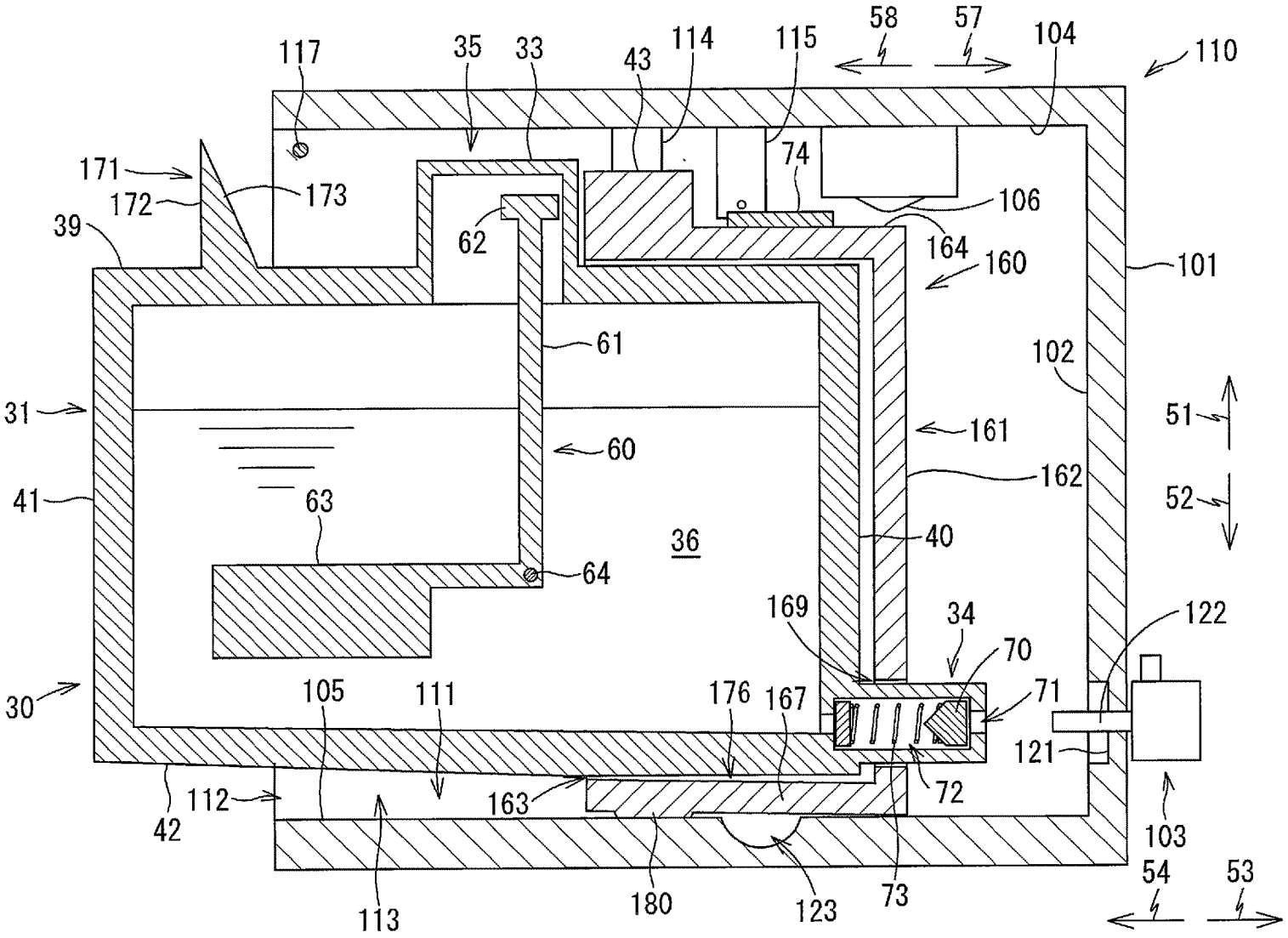
FIG. 6 is a cross-sectional view of the cartridge attachment section 110, the ink cartridge 30, and the adaptor 160, in which a protrusion 171 is positioned rearward of a lock pin 117 in a process of the ink cartridge 30 and the adaptor 160 being attached to the cartridge attachment section 110 according to the embodiment.
Figure 7:
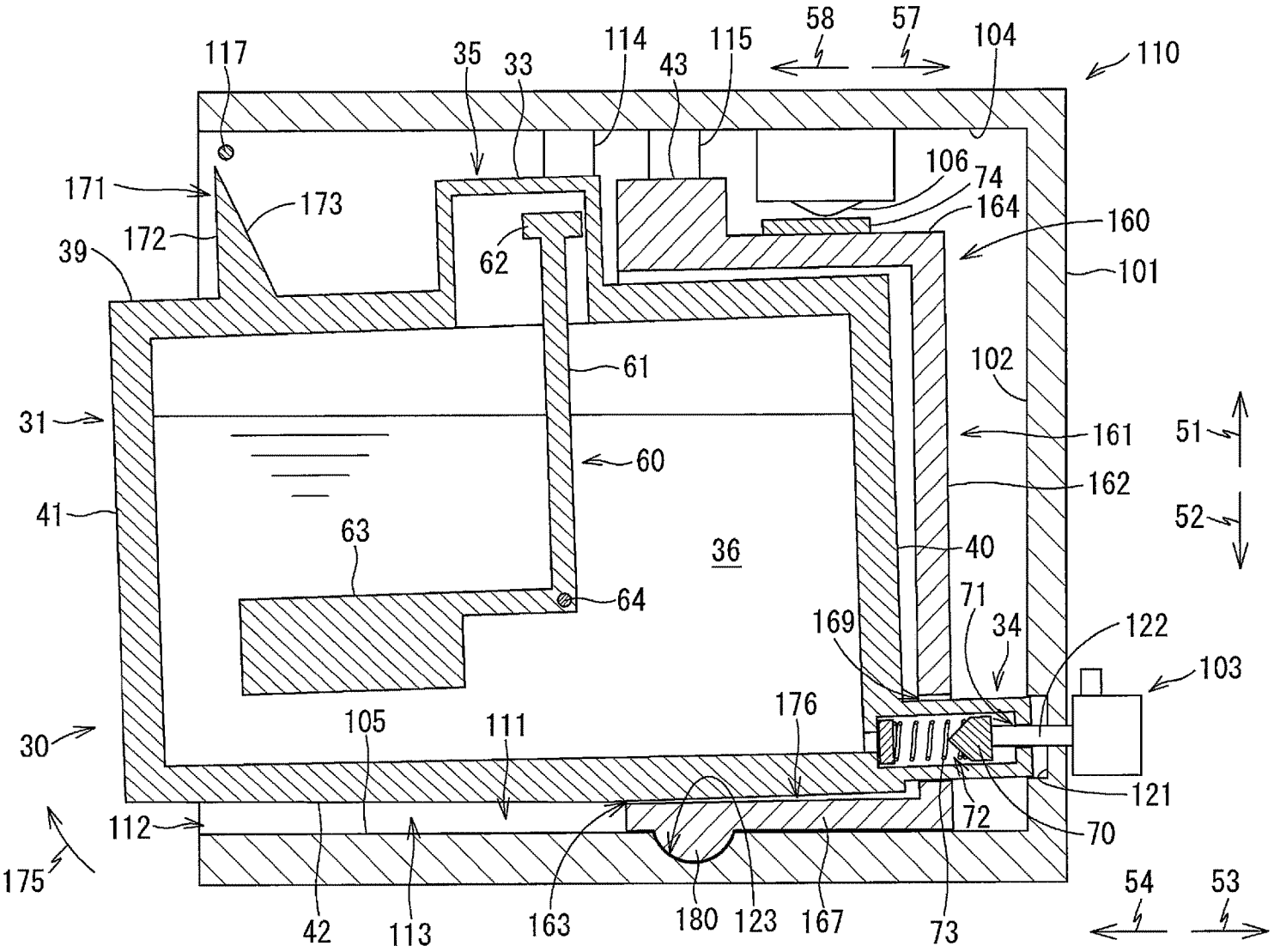
FIG. 7 is a cross-sectional view of the cartridge attachment section 110, the ink cartridge 30, and the adaptor 160, in which the protrusion 171 is positioned downward of the lock pin 117 in the process of the ink cartridge 30 and the adaptor 160 being attached to the cartridge attachment section 110 according to the embodiment.
Figure 8:
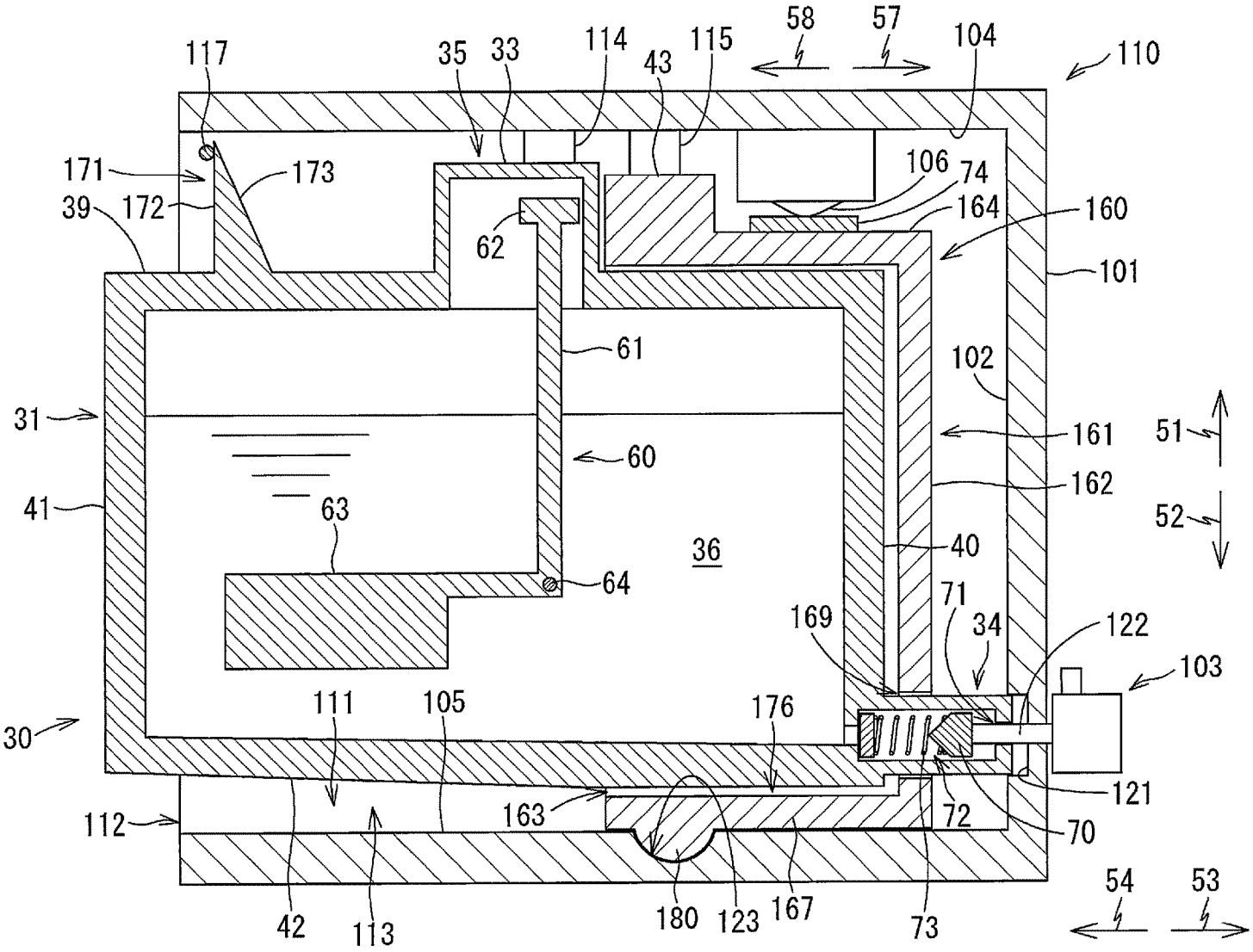
FIG. 8 is a cross-sectional view of the cartridge attachment section 110, the ink cartridge 30, and the adaptor 160, in which the ink cartridge 30 and the adaptor 160 have been attached to the cartridge attachment section 110 according to the embodiment.

In the following description, it is assumed that the ink cartridge 30 and the adaptor 160 are at their respective insertion postures unless otherwise specified. The insertion postures of the ink cartridge 30 and the adaptor 160 imply postures of the ink cartridge 30 and the adaptor 160 during a process of the ink cartridge 30 and the adaptor 160 being inserted into the cartridge attachment section 110 as illustrated in FIGS. 6 through 8. Note that, in the present embodiment, the ink cartridge 30 and the adaptor 160 are inserted into the cartridge attachment section 110 in a direction crossing a direction of gravity. At the insertion postures, the ink cartridge 30 in its upright state has been assembled to the adaptor 160 in its upright state as illustrated in FIG. 2 by inserting the ink cartridge 30 in the upright state illustrated in FIG. 3 into the adaptor 160 in the upright state illustrated in FIG. 3 from a rear side thereof. In the present embodiment, the upright state of the ink cartridge 30 and the upright state of the adaptor 160 are defined based on respective states of the ink cartridge 30 and the adaptor 160 when the insertion direction thereof crosses the direction of gravity.

<Ink Supply Device 100>

As illustrated in FIG. 1, the ink supply device 100 (as an example of a system) is provided in the printer 10. The ink supply device 100 is configured to supply ink to the recording head 21 provided in the printer 10. The ink supply device 100 includes the cartridge attachment section 110 to which the ink cartridges 30 and the adaptors 160 can be detachably attached. Note that FIG. 1 illustrates a state in which the ink cartridge 30 and the adaptor 160 have been attached to the cartridge attachment section 110.

<Ink Cartridge 30>

Figure 3:
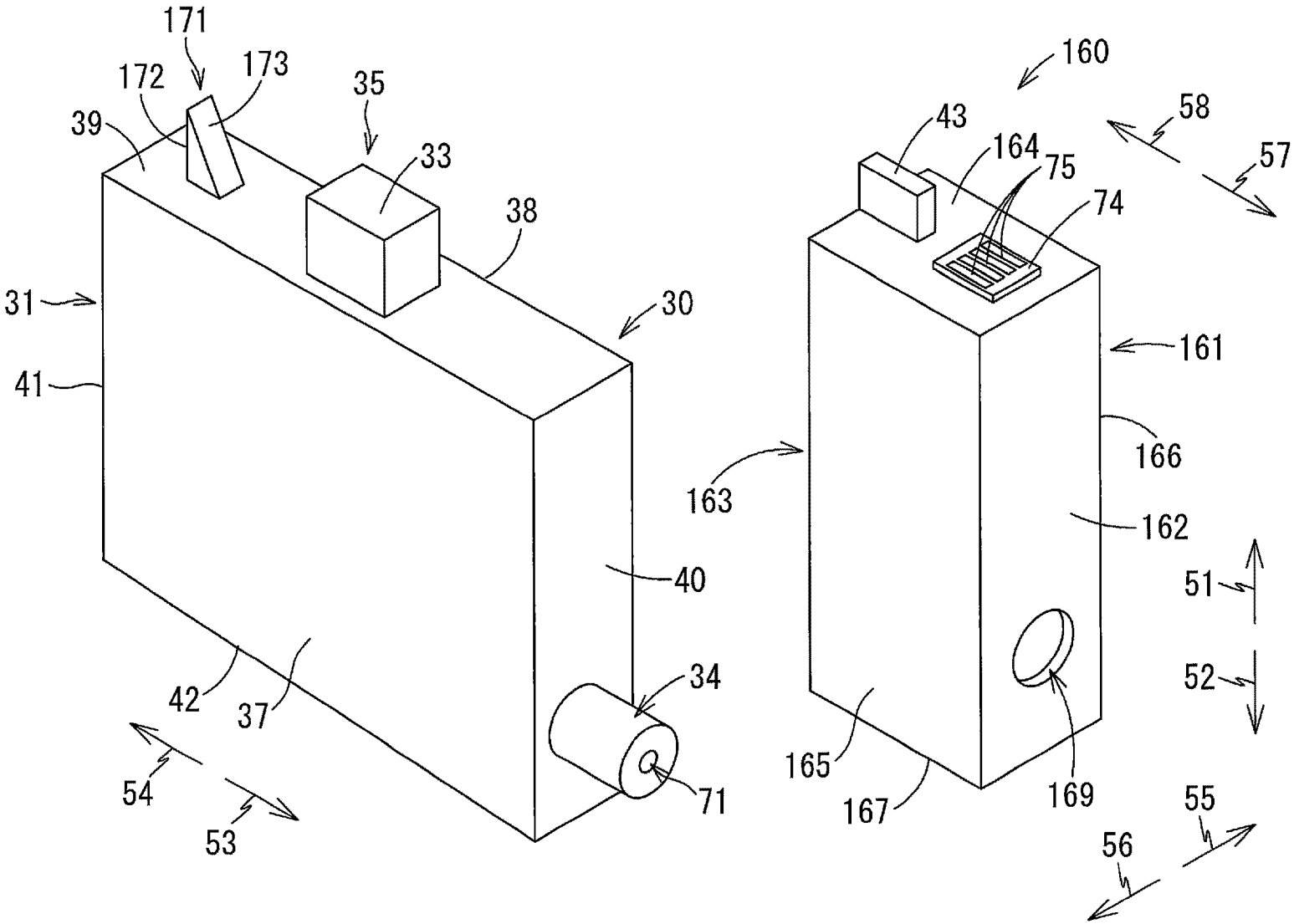
FIG. 3 is an exploded perspective view of the ink cartridge 30 and the adaptor 160 according to the embodiment.
Figure 4:
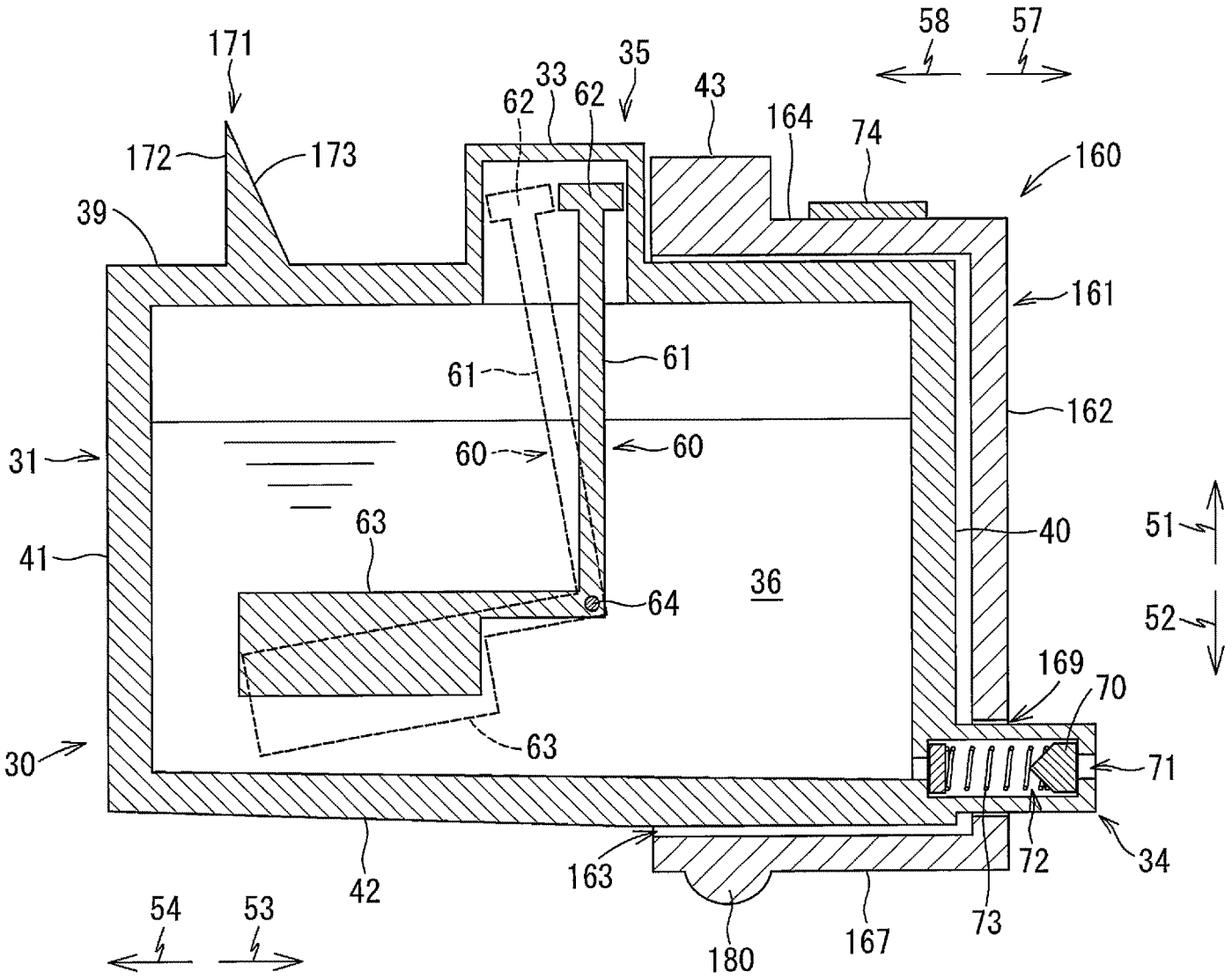
FIG. 4 is a cross-sectional view illustrating an internal configuration of the ink cartridge 30 and the adaptor 160 according to the embodiment.

As illustrated in FIGS. 2 through 4, each of the ink cartridges 30 is a container that is configured to store ink therein. When inserting the ink cartridge 30 into the cartridge attachment section 110 in an insertion direction 57 or removing the ink cartridge 30 from the cartridge attachment section 110 in a removal direction 58, the ink cartridge 30 is in the upright state illustrated in FIGS. 2 through 4, that is, with a surface of the ink cartridge 30 facing downward in FIGS. 2 through 4 as a bottom surface and a surface of the ink cartridge 30 facing upward in FIGS. 2 through 4 as a top surface. The insertion direction 57 and the removal direction 58 are parallel to the horizontal direction that is perpendicular to the gravitational direction. The ink cartridge 30 is inserted into and removed from the cartridge attachment section 110 while the ink cartridge 30 is in the upright state. A direction in which the ink cartridge 30 is inserted into the cartridge attachment section 110 is defined as the insertion direction 57, while a direction in which the ink cartridge 30 is removed from the cartridge attachment section 110 is defined as the removal direction 58. In the embodiment, the insertion direction 57 is a forward direction 53, while the removal direction 58 is a rearward direction 54. A downward direction 52 with respect to the ink cartridge 30 in the upright state is a direction of a gravitational force acting on the ink cartridge 30. An upward direction 51 with respect to the ink cartridge 30 in the upright state is a direction opposite to the direction of the gravitational force acting on the ink cartridge 30 (i.e. downward direction 52).

In the present embodiment, the insertion direction 57 and the removal direction 58 are parallel to the horizontal direction, but the insertion direction 57 and the removal direction 58 may not necessarily be parallel to the horizontal direction. The insertion direction 57 and the removal direction 58 may be parallel to the direction of gravity (vertical direction) or a direction crossing the horizontal direction and the direction of gravity. If the insertion direction 57 and the removal direction 58 are parallel to the direction of gravity, for example, a front surface of the ink cartridge 30 faces downward.

<Casing 31>

As illustrated in FIGS. 2 through 4, the ink cartridge 30 has a casing 31. The casing 31 has a three-dimensional configuration formed by flat surfaces or curved surfaces. The casing 31 has a shape that is similar to a rectangular parallelepiped, for example. The casing 31 has a flattened shape such that a dimension of the casing 31 in a leftward direction 55 and a rightward direction 56 is small and a dimension of the casing 31 in the upward direction 51 and the downward direction 52 and a dimension of the casing 31 in the forward direction 53 and the rearward direction 54 are greater than the dimension in the leftward direction 55 and the rightward direction 56.

The casing 31 has a front surface 40, a rear surface 41, a pair of left and right side surfaces 37, 38 (i.e. right surface 37 and left surface 38), and a top surface 39, and a bottom surface 42. The front surface 40 is a wall surface of the casing 31 facing forward (i.e. facing in the insertion direction 57) when the ink cartridge 30 is inserted into the cartridge attachment section 110 in the insertion direction 57. Further, the rear surface 41 is a wall surface of the casing 31 facing rearward (i.e. facing in the removal direction 58) when the ink cartridge 30 is inserted into the cartridge attachment section 110 in the insertion direction 57. The front surface 40 and the rear surface 41 are opposite to each other in the insertion direction 57 and the removal direction 58. The right surface 37 and the left surface 38 extend in the insertion direction 57 and the removal direction 58. The top surface 39 is connected to the right surface 37 and the left surface 38, and also connected to the front surface 40 and the rear surface 41. The top surface 39 extends from a top edge of the front surface 40 to a top edge of the rear surface 41 in the insertion direction 57 and the removal direction 58. The bottom surface 42 is connected to the right surface 37 and the left surface 38, and also connected to the front surface 40 and the rear surface 41. The bottom surface 42 extends from a bottom edge of the front surface 40 to a bottom edge of the rear surface 41 in the insertion direction 57 and the removal direction 58. The front surface 40 and the rear surface 41 are respectively defined by four wall surfaces of the casing 31, namely, the right surface 37, the left surface 38, the top surface 39 and the front surface 40. In other words, in the embodiment, when the ink cartridge 30 is at the insertion posture, a surface of the ink cartridge 30 facing forward or in the insertion direction 57 is the front surface 40; a surface of the ink cartridge 30 facing rearward or in the removal direction 58 is the rear surface 41; a surface of the ink cartridge 30 facing upward is the top surface 39; and a surface of the ink cartridge 30 facing downward is the bottom surface 42. That is, when the ink cartridge 30 is inserted into the cartridge attachment section 110 in the insertion direction 57, a front wall (a wall having the front surface 40) of the casing 31 constitutes a leading end of the casing 31 while a rear wall (a wall having the rear surface 41) of the casing 31 constitutes a trailing end of the casing 31. Specifically, with respect to the insertion direction 57, a front end of the casing 31 corresponds to the leading end of the casing 31 while a rear end of the casing 31 corresponds to the trailing end of the casing 31 in this embodiment.

Incidentally, each of the front surface 40, the rear surface 41, the top surface 39, the bottom surface 42, the right surface 37, and the left surface 38 is not necessarily formed by one flat surface. One surface or a plurality of surfaces of the casing 31 that is visible when the ink cartridge 30 is viewed in the rearward direction 54 may be recognized as the front surface 40. One surface or a plurality of surfaces of the casing 31 that is visible when the ink cartridge 30 is viewed in the forward direction 53 may be recognized as the rear surface 41. One surface or a plurality of surfaces of the casing 31 that is visible when the ink cartridge 30 is viewed in the downward direction 52 may be recognized as the top surface 39. One surface or a plurality of surfaces of the casing 31 that is visible when the ink cartridge 30 is viewed in the upward direction 51 may be recognized as the bottom surface 42. One surface or a plurality of surfaces of the casing 31 that is visible when the ink cartridge 30 is viewed in the leftward direction 55 may be recognized as the right surface 37. One surface or a plurality of surfaces of the casing 31 visible when the ink cartridge 30 is viewed in the rightward direction 56 may be recognized as the left surface 38.

An internal space formed in the casing 31 constitutes an ink chamber 36 for storing ink therein. The ink chamber 36 is located between the front surface 40 and the rear surface 41 of the casing 31.

<Ink Supply Portion 34>

As illustrated in FIGS. 2 through 4, the ink cartridge 30 includes an ink supply portion 34 (an example of a supply portion). The ink supply portion 34 is disposed at a lower portion of the front wall (i.e. the wall having the front surface 40) of the casing 31. The ink supply portion 34 has an external shape that is generally cylindrical. The ink supply portion 34 protrudes forward from the front surface 40. A protruding end of the ink supply portion 34 is formed with an ink supply port 71.

As illustrated in FIG. 4, the ink supply portion 34 has an ink channel 72 that provides communication between the ink supply port 71 and the ink chamber 36 through an internal space of the ink supply portion 34. The ink supply port 71 is configured to be opened and closed by an ink supply valve 70. The ink supply valve 70 is urged, by a coil spring 73 (an example of an urging member) disposed in the ink channel 72, in such a direction that the ink supply valve 70 closes the ink supply port 71. In other words, the ink supply valve 70 is urged in the forward direction 53 by the coil spring 73. As the ink cartridge 30 and the adaptor 160 are attached to the cartridge attachment section 110, an ink needle 122 (see FIG. 5) provided at the cartridge attachment section 110 advances into the ink supply port 71 and moves the ink supply valve 70 rearward against the urging force of the coil spring 73. A distal end of the ink needle 122 thus enters into the ink channel 72. As a result, ink in the ink chamber 36 flows into the ink needle 122 through the ink channel 72.

Incidentally, the ink supply port 71 is not necessarily be opened and closed by the ink supply valve 70. For example, the ink supply port 71 may be closed by a film. In this case, the ink needle 122 pierces through the film to open the ink supply port 71 when the ink cartridge 30 and the adaptor 160 are attached to the cartridge attachment section 110. Further, the casing 31 may have an air communication port for allowing the ink chamber 36 maintained at negative pressure to communicate with ambient air (atmosphere) therethrough. Through such an air communication port, the pressure in the ink chamber 36 can be adjusted from negative pressure to atmospheric pressure.

<Detection Portion 35>

As illustrated in FIG. 4, the ink cartridge 30 includes a detection portion 35. The detection portion 35 includes an indicator housing 33 and a sensor arm 60. In this embodiment, an indicator 62 (described later) of the sensor arm 60 and the indicator housing 33 constitute a remaining-amount detection portion (an example of a light accessible portion) for detection of remaining amount of ink in the ink chamber 36. The remaining-amount detection portion (the indicator housing 33 and the indicator 62) protrudes from the top surface 39 of the casing 31. That is, the remaining-amount detection portion is disposed at a position further upward than the top surface 39 of the casing 31.

As illustrated in FIGS. 2 through 4, the indicator housing 33 is provided on the top surface 39 of the casing 31 at a center portion thereof in the forward direction 53 and the rearward direction 54. The indicator housing 33 has a generally box shape, with one side of the indicator housing 33 being open for providing communication between an interior of the indicator housing 33 and the ink chamber 36. The indicator housing 33 has a pair of side walls (left wall and right wall), a front wall, a top wall, and a rear wall.

The pair of side walls of the indicator housing 33 is made of light-transmissive resin that allows transmission of light (e.g. infrared light) emitted from an optical sensor 114 (described later, FIG. 5) of the cartridge attachment section 110 and travelling in the leftward direction 55 or the rightward direction 56. The front wall, the top wall, and the rear wall of the indicator housing 33 are also made of light-transmissive resin. The side walls, the front wall, the top wall, and the rear wall of the indicator housing 33 define an internal space of the indicator housing 33. The walls constituting the indicator housing 33 allow transmission of light travelling in the leftward direction 55 or the rightward direction 56. In other words, the indicator housing 33 is provided at a position overlapping a path of light emitted from the optical sensor 114 when the ink cartridge 30 has been attached to the cartridge attachment section 110. The indicator housing 33 is integral with the casing 31.

Incidentally, in place of the light-transmissive resin, the indicator housing 33 may be provided by a reflection member that reflects light when the light is incident thereon at an angle exceeding a critical angle. Further, the light may be infrared light or visible light.

A space is formed between the pair of side walls (left and right walls) of the indicator housing 33 for storing ink therein. As illustrated in FIG. 4, the indicator 62 of the sensor arm 60 is located between the pair of left and right side walls of the indicator housing 33. The sensor arm 60 includes a plate-shaped arm body 61, the plate-shaped indicator 62 provided at a top end of the arm body 61, and a float 63 provided at a bottom end of the arm body 61. The float 63 is disposed rearward relative to the arm body 61.

The sensor arm 60 is pivotally movably supported to a pivot shaft 64 inside the ink chamber 36. The pivot shaft 64 is aligned in the leftward direction 55 and the rightward direction 56. The sensor arm 60 is configured to pivotally move in accordance with change in amount of ink remaining in the ink chamber 36. The sensor arm 60 can change its posture from a first posture (indicated by a solid line in FIG. 4) to a second posture (indicated by a dashed line in FIG. 4). When the sensor arm 60 is at the first posture, the indicator 62 is positioned at a front portion of the indicator housing 33. The position of the indicator 62 when the sensor arm 60 is at the first posture will be referred to as a first position. When the sensor arm 60 is at the second posture, the indicator 62 is positioned at a rear portion of the indicator housing 33. The position of the indicator 62 when the sensor arm 60 is at the second posture will be referred to as a second position. Note that FIG. 4 illustrates a state of the ink cartridge 30 in which an amount of ink in the ink chamber 36 is greater than a predetermined amount. When the amount of ink in the ink chamber 36 is greater than a predetermined amount, the sensor arm 60 is at the first posture and the indicator 62 is at the first position.

While the ink cartridge 30 and the adaptor 160 are attached to the cartridge attachment section 110 (i.e. when the ink cartridge 30 and the adaptor 160 are in attached states), the remaining-amount detection portion (the indicator housing 33 and the indicator 62) changes its state relative to the optical sensor 114 (FIG. 5) of the cartridge attachment section 110 from a state where the remaining-amount detection portion blocks or attenuates the infrared light travelling in the leftward direction 55 and the rightward direction 56 such that an amount of infrared light that has passed through the remaining-amount detection portion is smaller than a predetermined value to a state where the remaining-amount detection portion allows the infrared light travelling in the leftward direction 55 and the rightward direction 56 to pass therethrough such that an amount of the infrared light that has passed through the remaining-amount detection portion is equal to or greater than the predetermined value. Specifically, when the indicator 62 is at the first position (indicated by a solid line in FIG. 4), the indicator 62 is disposed at a position overlapping a path of the infrared light travelling from the optical sensor 114 in the leftward direction 55 or the rightward direction 56. Thus, the indicator 62 blocks or attenuates the infrared light passing through the indicator housing 33. When the indicator 62 is at the second position (indicated by a dashed line in FIG. 4), the indicator 62 is positioned offset relative to the path of the infrared light. Thus, the infrared light can pass through the indicator housing 33. In this way, whether an amount of ink remaining in the ink chamber 36 becomes smaller than the predetermined amount can be determined in accordance with change of the amount of the infrared light passing through the remaining-amount detection portion.

Note that, when the ink cartridge 30 and the adaptor 160 are in their attached states, the ink cartridge 30 and the adaptor 160 are in their respective upright states. That is, the ink cartridge 30 and the adaptor 160 are attached to the cartridge attachment section 110 in an attachment direction crossing the direction of gravity, at which time the ink supply port 71 faces in the attachment direction.

Incidentally, the detection portion 35 may not have the sensor arm 60. The optical sensor 114 has a light-emitting element and a light-receiving element disposed opposite to each other in the leftward direction 55 and the rightward direction 56, as described later in detail. Infrared light emitted from the light-emitting element of the optical sensor 114 travels in the leftward direction 55 or the rightward direction 56 and is received by the light-receiving element of the optical sensor 114. The detection portion 35 may be configured such that the infrared light emitted from the light-emitting element of the optical sensor 114 may be blocked or attenuated by the remaining-amount detection portion when an amount of ink in the ink chamber 36 is equal to or greater than the predetermined amount and that the infrared light emitted from the light-emitting element of the optical sensor 114 may pass through the remaining-amount detection portion such that an amount of the infrared light that has passed through the remaining-amount detection portion is equal to or greater than the predetermined value when an amount of ink in the ink chamber 36 is less than the predetermined amount.

Alternatively, the detection portion 35 may not have the indicator housing 33. A lever as the remaining-amount detection portion and a soft film supporting the lever may instead be provided. In this case, the soft film is inflated when ink is stored in the ink chamber 36, and the lever is pivotally movable and exposed to an outside. When contacting the film, the lever is maintained at a position blocking the infrared light. When no or little ink remains in the ink chamber 36, the film shrinks, thereby pivotally moving the lever downward to be moved to a position not blocking the infrared light.

Still alternatively, the infrared light emitted from the light-emitting element of the optical sensor 114 may be reflected so as not to reach the light-receiving element of the optical sensor 114 when ink is stored in the ink chamber 36, and may be reflected so as to reach the light-receiving element of the optical sensor 114 when no or little ink remains in the ink chamber 36.

<Protruding Portion 171>

As illustrated in FIGS. 2 through 4, the ink cartridge 30 has a protrusion 171 (an example of an engagement portion). The protrusion 171 is formed on the top surface 39 of the casing 31. The protrusion 171 protrudes upward from the top surface 39 of the casing 31. The protrusion 171 is disposed closer to the trailing end of the casing 31 than the leading end of the casing 31 in the insertion direction 57 and the removal direction 58 (i.e. the forward direction 53 and the rearward direction 54). The protrusion 171 is positioned rearward of the indicator housing 33. A top end of the protrusion 171 is positioned higher than a top end of the indicator housing 33. That is, the indicator housing 33 is positioned forward of the protrusion 171. In other words, the indicator housing 33 is positioned closer to the leading end of the casing 31 than the protrusion 171 is to the leading end of the casing 31 in the insertion direction 57. Further, the top end of the indicator housing 33 is positioned lower than the top end of the protrusion 171. The protrusion 171 has a rear surface 172 facing rearward and a front surface 173 facing forward.

<Adaptor 160>

Each of the four adaptors 160 can be assembled to corresponding one of the four ink cartridges 30. The adaptor 160 may have a configuration that enables any one of the four ink cartridges 30 to be assembled thereto provided that information stored in an IC mounted on the adaptor 160 does not include information on color of ink.

As illustrated in FIGS. 2 through 4, the adaptor 160 has an adaptor body 161. The adaptor body 161 has a shape covering at least a part of outer surfaces constituting the casing 31 of the ink cartridge 30. In this embodiment, the adaptor body 161 has a flattened container-like shape that can cover the front surface 40, a part of the right surface 37, a part of the left surface 38, a part of the top surface 39, and a part of the bottom surface 42 of the casing 31 from an outer side thereof.

The adaptor body 161 has a width (a dimension in the rightward direction 56) and a height (a dimension in the upward direction 51) that can cover the front surface 40 in its entirety of the casing 31 of the ink cartridge 30, and a depth (a dimension in the rearward direction 54) that can cover a part of the right surface 37, a part of the left surface 38, a part of the top surface 39, and a part of the bottom surface 42 of the casing 31 of the ink cartridge 30. That is, the adaptor body 161 has a width that is slightly greater than a width of the casing 31, and has a height that is slightly greater than a height of the casing 31, and has a depth smaller than a depth of the casing 31.

The adaptor body 161 has a front wall 162, a top wall 164, a pair of left and right side walls 165, 166 (i.e. right wall 165 and left wall 166), and a bottom wall 167. Further, the adaptor body 161 has an opening 163 that is open rearward. The front wall 162 is provided at a position opposite to the front surface 40 of the casing 31 when the ink cartridge 30 has been inserted into the adaptor 160. The opening 163 is positioned opposite to the front wall 162 in the rearward direction 54. Through the opening 163, the casing 31 can be inserted into the adaptor body 161. That is, the adaptor body 161 receives the casing 31 through the opening 163 as the casing 31 is inserted into the adaptor body 161 in the insertion direction 57. The top wall 164 is provided at a position opposite to the top surface 39 of the casing 31 when the ink cartridge 30 has been inserted into the adaptor 160. The right wall 165 and the left wall 166 are provided at positions opposite to the right surface 37 and the left surface 38 of the casing 31, respectively, when the ink cartridge 30 has been inserted into the adaptor 160. The bottom wall 167 is provided at a position opposite to the bottom surface 42 of the casing 31 when the ink cartridge 30 has been inserted into the adaptor 160. The top wall 164, the side walls 165, 166, and the bottom wall 167 are positioned between the front wall 162 and the opening 163.

When the adaptor 160 is inserted into the cartridge attachment section 110 in the insertion direction 57 or removed from the cartridge attachment section 110 in the removal direction 58, the adaptor 160 is in its upright state illustrated in FIGS. 2 through 4, with a surface of the adaptor 160 facing downward in FIGS. 2 through 4 as a bottom surface and a surface of the adaptor 160 facing upward in FIGS. 2 through 4 as a top surface. Note that the direction in which the adaptor 160 is inserted into the cartridge attachment section 110 is substantially the same as the direction in which the ink cartridge 30 is inserted into the cartridge attachment section 110. The insertion direction 57 and the removal direction 58 are parallel to the horizontal direction. That is, the adaptor 160 is inserted into and removed from the cartridge attachment section 110 while the adaptor 160 is in the upright state. In other words, in the embodiment, when the adaptor 160 is at the insertion posture, the front wall 162 constitutes a front end of the adaptor body 161; the top wall 164 constitutes a top end of the adaptor body 161; and the bottom wall 167 constitutes a bottom end of the adaptor body 161. That is, when the adaptor 160 is inserted into the cartridge attachment section 110 in the insertion direction 57, the front wall 162 constitutes a leading end of the adaptor body 161 while the opening 163 is formed at a trailing end of the adaptor body 161. Specifically, with respect to the insertion direction 57, a front end of the adaptor body 161 corresponds to the leading end of the adaptor body 161 while a rear end of the adaptor body 161 corresponds to the trailing end of the adaptor body 161 in this embodiment.

The front wall 162 of the adaptor body 161 has a hole 169 at a lower portion thereof. The hole 169 penetrates the front wall 162 in the forward direction 53 and the rearward direction 54. The hole 169 is a passage for exposing the ink supply portion 34 provided on the casing 31 to an outside of the adaptor body 161 when the casing 31 of the ink cartridge 30 is inserted into the adaptor body 161. Hence, the hole 169 is formed at a position capable of receiving the ink supply portion 34 and has a size and a shape in conformance with those of the ink supply portion 34. The hole 169 is an example of an opening.

When the ink cartridge 30 and the adaptor 160 are assembled to each other, the ink supply portion 34 is supported at an edge defining the hole 169, so that the adaptor 160 maintains the ink cartridge 30 at its insertion posture. A state where the ink cartridge 30 is assembled to the adaptor 160 such that the ink supply portion 34 extends through the hole 169 and is supported by the hole 169 will be referred to as an assembled state.

In the assembled state of the ink cartridge 30 and the adaptor 160, the ink cartridge 30 is in the upright state and the adaptor 160 is in the upright state. In the assembled state, the remaining-amount detection portion (i.e. the indicator housing 33 and the indicator 62) is positioned further upward than the top wall 164 of the adaptor body 161.

<Convex 180>

As illustrated in FIG. 4, the adaptor body 161 has a convex 180 (an example of an adaptor engagement portion, an example of a protrusion) on a bottom surface of the bottom wall 167. The convex 180 protrudes downward from the bottom wall 167. The convex 180 is made of an elastic material. The convex 180 is elastically deformable upward. In a state where the adaptor 160 is attached to the cartridge attachment section 110 (a state illustrated in FIG. 8), the convex 180 having a convex outer surface facing rearward is fitted into a concave 123 formed in the cartridge attachment section 110. The convex 180 is thus engaged with the concave 123. Engagement of the convex 180 with the concave 123 can restrict the adaptor 160 from moving rearward (in a direction opposite to the insertion direction 57, i.e. removal direction 58) relative to the cartridge attachment section 110.

In the process of the adaptor 160 being inserted into the cartridge attachment section 110, the convex 180 is pressed against an inner bottom surface 105 (FIG. 5) of the cartridge attachment section 110, thereby being elastically deformed upward (see FIG. 6). When the adaptor 160 is further inserted into the cartridge attachment section 110, the convex 180 reaches the concave 123 and is fitted into the concave 123. Hence, the convex 180 engages with the concave 123 (see FIG. 8).

Incidentally, the convex 180 may be integral with the bottom wall 167 and formed in the same material as the bottom wall 167, such as resin. In this case, during the process of the adaptor 160 being inserted into and removed from the cartridge attachment section 110, the bottom wall 167 may be resiliently deformed upward while the convex 180 is pressed against the inner bottom surface 105.

Further, the convex 180 may not be formed integrally with the bottom wall 167. The convex 180 may be separate from the bottom wall 167 and fixed to the bottom wall 167 with adhesive, for example. Alternatively, the convex 180 may be provided by a leaf spring.

Further, engagement of the adapter 160 with the cartridge attachment section 110 is not limited to the one achieved by engaging the convex 180 with the concave 123. Any configuration known in the art may be available.

<Light Attenuation Portion 43>

As illustrated in FIGS. 2 through 4, the adaptor 160 includes a light attenuation portion 43 as an example of a light attenuation portion and an example of a light attenuation wall. The light attenuation portion 43 is disposed on a top surface of the top wall 164 of the adaptor body 161. The light attenuation portion 43 is positioned forward of the indicator housing 33 when the casing 31 of the ink cartridge 30 has been inserted into the adaptor body 161 of the adaptor 160 (a state illustrated in FIG. 2). In other words, the light attenuation portion 43 is positioned closer to the leading end of the adaptor body 161 than the indicator housing 33 is to the leading end of the adaptor body 161 in the insertion direction 57 when the casing 31 has been inserted into the adaptor body 161.

The light attenuation portion 43 is a rib formed in a thin plate shape. The light attenuation portion 43 extends upward from the top wall 164. The light attenuation portion 43 has a thickness in the leftward direction 55 and the rightward direction 56 as a thickness direction. A dimension of the light attenuation portion 43 in the leftward direction 55 and the rightward direction 56 is smaller than a dimension of the indicator housing 33 in the leftward direction 55 and the rightward direction 56. In a state where the adaptor 160 is attached to the cartridge attachment section 110 (a state illustrated in FIG. 8), the light attenuation portion 43 blocks or attenuates light (e.g. infrared light) emitted from an optical sensor 115 (FIG. 5) and travelling in the leftward direction 55 or the rightward direction 56.

<IC Board 74>

As illustrated in FIGS. 2 through 4, an IC board 74 (an example of an electrical interface and an example of a circuit board) is provided on a top surface (an example of an outer surface) of the top wall 164 of the adaptor body 161. The IC board 74 is positioned forward of the light attenuation portion 43. The IC board 74 is electrically connected to a plurality of electric contacts 106 (described later) when the adaptor 160 has been attached to in the cartridge attachment section 110 (see FIG. 8).

An IC (not illustrated) and three electrodes 75 including a HOT electrode, a GND electrode and a signal electrode are mounted on the IC board 74. The IC is a semiconductor integrated circuit. The IC stores data indicative of information on the ink cartridge 30 (for example, a color of ink and a manufacturer of the ink cartridge 30) that need not be updated in association with replacement of the ink cartridge 30. External access to the IC enables the data stored in the IC to be retrieved therefrom.

The respective three electrodes 75 (i.e. the HOT electrode, the GND electrode, and the signal electrode) are electrically connected to the IC. The HOT electrode, the GND electrode, and the signal electrode extend in the forward direction 53 and the rearward direction 54, respectively, and are arranged spaced apart from each other in the leftward direction 55 and the rightward direction 56. The HOT electrode, the GND electrode, and the signal electrode are mounted on a top surface of the IC board 74 and are exposed to an outside so as to be electrically accessible from the outside. In other words, the HOT electrode, the GND electrode, and the signal electrode are exposed to an outside and can be accessed from above the ink cartridge 30 in the attached state.

As illustrated in FIG. 8, when the adaptor 160 has been attached to the cartridge attachment section 110 (attached state), the adaptor 160 is supported to the cartridge attachment section 110 such that the bottom wall 167 of the adaptor body 161 contacts the inner bottom surface 105 of the cartridge attachment section 110. With this structure, the adaptor 160 in the attached state can maintain electrical connection between the IC board 74 mounted on the top wall 164 of the adaptor body 161 and the electric contacts 106.

<Cartridge Attachment Section 110>

Figure 5:
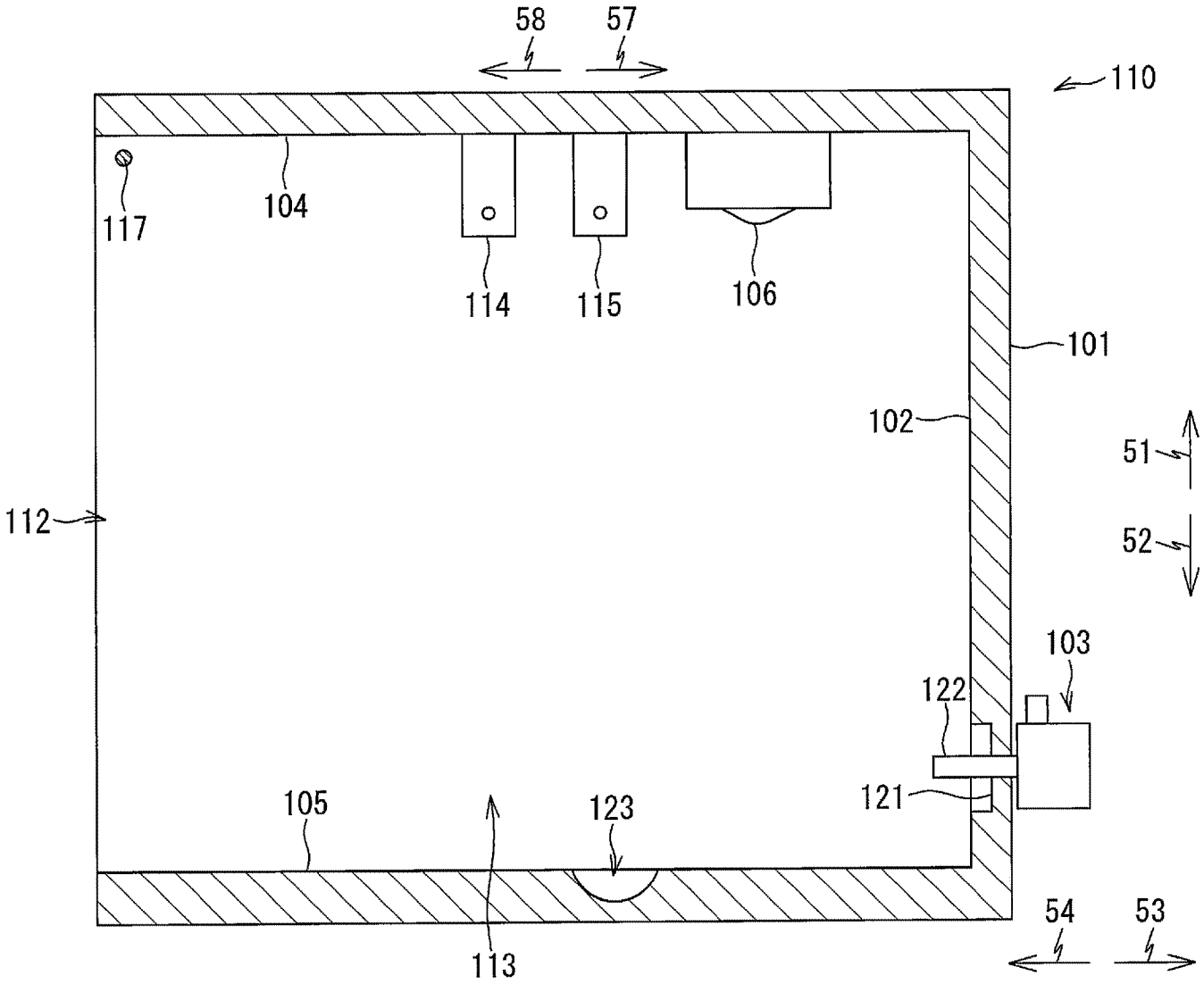
FIG. 5 is a cross-sectional view illustrating a configuration of the cartridge attachment section 110 according to the embodiment.

As illustrated in FIG. 5, the cartridge attachment section 110 has a case 101 constituting a housing of the cartridge attachment section 110. The case 101 has the opening 112 on a rear side thereof. The case 101 defines an internal space 113 (an example of an accommodating space). The four ink cartridges 30 and the four adaptors 160 are inserted into and removed from the case 101 through the opening 112 and accommodated in the internal space 113 of the case 101. In other words, the case 101 can accommodate therein the four ink cartridges 30 corresponding to the respective colors of cyan, magenta, yellow, and black, and the four adaptors 160 corresponding to the four ink cartridges 30. However, for an explanatory purpose, FIG. 5 illustrates the internal space 113 of the case 101 in which only one ink cartridge 30 and only one adaptor 160 can be accommodated.

The cartridge attachment section 110 includes four connecting portions 103. As illustrated in FIG. 5 (only one connecting portion 103 is illustrated), the connecting portions 103 are disposed at a lower portion of an end wall (a wall having an inner end surface 102) of the case 101. The connecting portions 103 are provided at positions corresponding to the ink supply portions 34 of the four ink cartridges 30 attached to the case 101, respectively.

Each of the connecting portions 103 includes a retaining portion 121 and the ink needle 122. The ink needle 122 is made of resin having a tubular configuration. The connecting portion 103 is connected to the corresponding ink tube 20 at an outer side of the case 101, i.e. a side of the case 101 facing an outer end surface of the end wall opposite to the inner end surface 102 of the case 101. Specifically, the ink tube 20 is connected to the connecting portion 103 so that communication between the ink needle 122 and the ink tube 20 is provided.

The ink tube 20 connected to the connecting portion 103 at the outer side of the case 101 extends upward from the connecting portion 103 along the outer end surface of the case 101 to the recording head 21 of the printer 10, thereby allowing ink to be supplied to the recording head 21. Note that the ink tube 20 is not illustrated in FIG. 5.

The retaining portion 121 is a cylindrical-shaped groove formed in the end wall of the case 101. The ink needle 122 is disposed at the center of the retaining portion 121. As illustrated in FIG. 8, when the ink cartridge 30 and the adaptor 160 are attached to the cartridge attachment section 110, the ink supply portion 34 is inserted into the cylindrical-shaped retaining portion 121. At this time, an outer circumferential surface of the ink supply portion 34 tightly contacts an inner circumferential surface of the cylindrical-shaped retaining portion 121. Hence, the ink supply portion 34 is accommodated in the retaining portion 121 with a prescribed gap between the protruding end of the ink supply portion 34 and a bottom surface of the retaining portion 121. When the ink supply portion 34 is inserted into the retaining portion 121, the ink needle 122 advances into the ink supply port 71 of the ink supply portion 34. The ink stored in the ink chamber 36 can thus flow out therefrom. The ink flowing out from the ink chamber 36 flows into the ink needle 122.

Four optical sensors 114 and four optical sensors 115 are provided at the cartridge attachment section 110, corresponding to the four ink cartridges 30 and the four adaptors 160. For an explanatory purpose, only one of the optical sensors 114 and only one of the optical sensors 115 are illustrated in FIG. 5.

As illustrated in FIG. 5, the optical sensor 114 and the optical sensor 115 are disposed on an inner top surface 104 of the case 101 that defines a top edge of the internal space 113 of the case 101. The optical sensor 115 is positioned forward of the optical sensor 114.

Each optical sensor 114 includes the light-emitting element such as an LED and the light-receiving element such as a photo-transistor. The light-emitting element and the light-receiving element of the optical sensor 114 are enclosed by a housing formed in a horseshoe shape. The optical sensor 114 has an external shape provided by its housing, and thus, the external shape thereof is horseshoe-shaped. The light-emitting element of the optical sensor 114 can emit light travelling in one direction (in this embodiment, either one of the leftward direction 55 and the rightward direction 56). The light-receiving element of the optical sensor 114 can receive the light emitted from the light-emitting element of the optical sensor 114 in the one direction. The light-emitting element and the light-receiving element of the optical sensor 114 are disposed within the horseshoe-shaped housing and are arranged in conformation with each other and spaced apart from each other by a prescribed distance in the leftward direction 55 and the rightward direction 56.

Similarly to the optical sensor 114, each optical sensor 115 also includes a light-emitting element such as an LED and a light-receiving element such as a photo-transistor. The light-emitting element and the light-receiving element of the optical sensor 115 are enclosed by a housing formed in a horseshoe shape. The optical sensor 115 has an external shape provided by its housing, and thus, the external shape thereof is horseshoe-shaped. The light-emitting element of the optical sensor 115 can emit light travelling in one direction (in this embodiment, either one of the leftward direction 55 and the rightward direction 56). The light-receiving element of the optical sensor 115 can receive the light emitted from the light-emitting element of the optical sensor 115 in the one direction. The light-emitting element and the light-receiving element of the optical sensor 115 are disposed within the horseshoe-shaped housing and are arranged in conformation with each other and spaced apart from each other by a prescribed distance in the leftward direction 55 and the rightward direction 56.

The light attenuation portion 43 of the adaptor 160 and the indicator housing 33 of the ink cartridge 30 can enter the space between the light-emitting element and light-receiving element of the optical sensor 114. The light attenuation portion 43 of the adaptor 160 can enter the space between the light-emitting element and the light-receiving element of the optical sensor 115.

When the ink cartridge 30 and the adaptor 160 have been attached to the cartridge attachment section 110 as illustrated in FIG. 8 and the indicator housing 33 enters a path of light emitted from the light-emitting element of the optical sensor 114, the light-emitting element of the optical sensor 114 emits light toward the indicator housing 33. Hence, the change in amount of light passing the remaining-amount detection portion (i.e. the indicator housing 33 and the indicator 62) can be detected through the optical sensor 114. Further, when the ink cartridge 30 and the adaptor 160 have been attached to cartridge attachment section 110 as illustrated in FIG. 8 and the light attenuation portion 43 enters a path of light emitted from the light-emitting element of the optical sensor 115, the light-emitting element of the optical sensor 115 emits light toward the light attenuation portion 43. Hence, the change in amount of light passing the light attenuation portion 43 can also be detected through the optical sensor 115.

As illustrated in FIG. 5, the plurality of electric contacts 106 is disposed at the inner top surface 104 of the case 101 at a position closer to the inner end surface 102 of the case 101 than the optical sensor 115 to the inner end surface 102. Three electric contacts 106 are provided, corresponding to the three electrodes 75. The three electric contacts 106 are arranged spaced apart from each other in the leftward direction 55 and the rightward direction 56. The arrangement of the three electric contacts 106 corresponds to the arrangement of the three electrodes 75 (i.e. the HOT electrode, the GND electrode, and the signal electrode) mounted on the IC board 74 of the adaptor 160. Each of the electric contacts 106 is made of a resilient and electrically conductive material. Each electric contact 106 is resiliently deformable upward.

Each of the electric contacts 106 is connected to a computing device through an electric circuit. The computing device may include a CPU, a ROM, a RAM, and the like, for example. A controller of the printer 10 may function as the computing device. When one of the electric contacts 106 is electrically connected to the HOT electrode, a voltage Vc is applied to the HOT electrode. When another of the electric contacts 106 is electrically connected to the GND electrode, the GND electrode is grounded. Electrical connection between the electric contacts 106 and the HOT and GND electrodes supplies electric power to the IC. When the other of the electric contacts 106 is electrically connected to the signal electrode, data stored in the IC become accessible. Output from the electric circuit is inputted into the computing device.

As illustrated in FIG. 5, the cartridge attachment section 110 is provided with a lock pin 117. The lock pin 117 is provided at a position near the inner top surface 104 of the case 101 and also at a position closer to the opening 112 than the optical sensor 114 to the opening 112. The lock pin 117 has a columnar shape extending in the leftward direction 55 and the rightward direction 56. The lock pin 117 is disposed at a position so as not to contact the IC board 74, the light attenuation portion 43, and the indicator housing 33 when the ink cartridge 30 and the adaptor 160 are being inserted into the cartridge attachment section 110. In other words, the lock pin 117 is positioned upward of the IC board 74, the light attenuation portion 43, and the indicator housing 33 when the ink cartridge 30 and the adaptor 160 have been attached to the cartridge attachment section 110. In a state illustrated in FIG. 8 in which the ink cartridge 30 and the adaptor 160 have been attached to the cartridge attachment section 110 (i.e. attached state), the rear surface 172 of the protrusion 171 engages with the lock pin 117, maintaining the ink cartridge 30 and the adaptor 160 at the attached state.

<Operation for Attaching Ink Cartridge 30 and Adaptor 160 to Cartridge Attachment Section 110>

Next, an operation for attaching the ink cartridge 30 and the adaptor 160 to the cartridge attachment section 110 will be described while referring to FIGS. 6 through 8.

When a user attempts to use the printer 10 for the first time after purchasing the printer 10, neither the ink cartridge 30 of any color nor the adaptor 160 corresponding thereto is attached to the cartridge attachment section 110. Further, the ink cartridge 30 has not yet been assembled to the adaptor 160 before the ink cartridge 30 and the adaptor 160 are attached to the cartridge attachment section 110 for the first time.

The user first assembles the ink cartridge 30 to the adapter 160, as illustrated in FIG. 2. Then, the user inserts the ink cartridge 30 and the adaptor 160 in the assembled state into the cartridge attachment section 110. At this time, the adaptor 160 is pushed by the ink cartridge 30 from rear and inserted into the cartridge attachment section 110 together with the ink cartridge 30.

When the ink cartridge 30 and the adapter 160 are being inserted into the cartridge attachment section 110, the convex 180 is supported by the inner bottom surface 105 of the cartridge attachment section 110 as illustrated in FIG. 6. At this time, the convex 180 is pressed against the inner bottom surface 105 and elastically deformed. While the convex 180 is elastically deformed, the ink cartridge 30 and the adaptor 160 moves forward (i.e. in the insertion direction 57) in the internal space 113 of the cartridge attachment section 110.

In the process of the ink cartridge 30 and the adaptor 160 being inserted into the cartridge attachment section 110, the front surface 173 of the protrusion 171 abuts against the lock pin 117 from rear. Abutment of the protrusion 171 against the lock pin 117 restricts further insertion of the ink cartridge 30 and the adaptor 160 into the cartridge attachment section 110. In this state, the user pivotally moves the ink cartridge 30 about a front portion thereof, moving a rear portion of the ink cartridge 30 downward.

More specifically, when the user pushes a rear portion of the top surface 39 downward, the ink cartridge 30 is pivotally moved downward (i.e. in a counterclockwise direction in FIG. 6) about the ink supply portion 34 (more precisely, a portion of the ink supply portion 34 that contacts the hole 169 of the adaptor 160 to be fixed in position relative to the adaptor 160) against a force for maintaining the ink cartridge 30 at the insertion posture (see FIG. 7).

Incidentally, a gap 111 is formed between the bottom surface 42 of the ink cartridge 30 and the inner bottom surface 105 of the cartridge attachment section 110 for allowing the ink cartridge 30 to pivotally move downward. Further, a gap 176 is formed between the bottom surface 42 of the ink cartridge 30 and the bottom wall 167 of the adaptor 160 for allowing the ink cartridge 30 to pivotally move downward.

As described above, the ink cartridge 30 may be pivotally moved during the process of the ink cartridge 30 being inserted into the cartridge attachment section 110. Alternatively, the ink cartridge 30 may be pivotally moved before inserted into the cartridge attachment section 110, and then, inserted into the cartridge attachment section 110 while maintaining its pivotally moved state.

As the ink cartridge 30 is pivotally moved, the protrusion 171 is moved to a position below the lock pin 117 as illustrated in FIG. 7. In this state, the ink cartridge 30 and the adaptor 160 are further moved forward in the internal space 113 of the cartridge attachment section 110. The protrusion 171 is thus positioned forward of the lock pin 117. In this state, the user pivotally moves the ink cartridge 30 about the front portion thereof, moving the rear portion of the ink cartridge 30 upward. That is, the ink cartridge 30 is pivotally moved in a direction indicated by an arrow 175 illustrated in FIG. 7 (i.e. in a clockwise direction in FIG. 7).

The rear surface 172 of the protrusion 171 can therefore contact the lock pin 117 from front (see FIG. 8). In other words, the rear surface 172 of the protrusion 171 can engage with the lock pin 117.

As illustrated in FIG. 8, the rear surface 172 of the protrusion 171 of the ink cartridge 30 is positioned forward of the lock pin 117 and in contact with the lock pin 117 when the ink cartridge 30 and the adaptor 160 are in the attached state, that is, when the ink cartridge 30 and the adaptor 160 have been completely attached to the cartridge attachment section 110. In the attached state, the coil spring 73 compressed in the ink supply portion 34 applies an urging force directing in the removal direction 58 (i.e. rearward direction 54) to the casing 31 of the ink cartridge 30.

Since the rear surface 172 contacts the lock pin 117 from a front side thereof and engages with the lock pin 117, the ink cartridge 30 is maintained at the attached state against the urging force of the coil spring 73. Note that the urging force of the coil spring 73 is not applied to the adaptor 160.

As the ink cartridge 30 and the adaptor 160 are further moved forward in the internal space 113 of the cartridge attachment section 110 from the positions illustrated in FIG. 7, the convex 180 reaches a position immediate above the concave 123. At this time, the convex 180 is fitted into the concave 123, while elastically restoring its original shape. The convex 180 is thus engaged with the concave 123, whereby the adaptor 160 is retained in the cartridge attachment section 110. Hence, the adaptor 160 is maintained at its attached state.

While the ink cartridge 30 and the adaptor 160 are attached to the cartridge attachment section 110 (i.e. in the attached state) as illustrated in FIG. 8, the light attenuation portion 43 is positioned between the light-emitting element of the optical sensor 115 and the light-receiving element of the optical sensor 115, and is detected through the optical sensor 115. Specifically, when the light attenuation portion 43 is positioned between the light-emitting element of the optical sensor 115 and the light-receiving element of the optical sensor 115, the optical sensor 115 outputs a detection signal different from a detection signal when the light attenuation portion 43 is not positioned between the light-emitting element of the optical sensor 115 and the light-receiving element of the optical sensor 115. Based on the change in detection signal outputted from the optical sensor 115, the controller of the printer 10 determines that the adaptor 160 has been inserted into and attached to the cartridge attachment section 110.

Further, as illustrated in FIG. 8, while the ink cartridge 30 and the adaptor 160 are attached to the cartridge attachment section 110 (i.e. in the attached state), the indicator 62 of the sensor arm 60 disposed in the indicator housing 33 is positioned between the light-emitting element of the optical sensor 114 and the light-receiving element of the optical sensor 114. The indicator 62 is thus detected through the optical sensor 114. Specifically, when the indicator 62 is positioned between the light-emitting element of the optical sensor 114 and the light-receiving element of the optical sensor 114, the optical sensor 114 outputs a detection signal different from a detection signal when the indicator 62 is not positioned between the light-emitting element of the optical sensor 114 and the light-receiving element of the optical sensor 114. For example, the detection signal outputted from the optical sensor 114 is changed from a high level signal to a low level signal.

When an amount of ink in the ink chamber 36 is reduced, the sensor arm 60 is pivotally moved from the first posture (indicated by the solid line in FIG. 4) to the second posture (indicated by the dashed line in FIG. 4). As a result, the indicator 62 of the sensor arm 60 moves out of a position between the light-emitting element of the optical sensor 114 and the light-receiving element of the optical sensor 114. The detection signal of the optical sensor 114 is thus changed from a low level signal to a high level signal, for example, inversely with the change in detection signal when the ink cartridge 30 and the adaptor 160 are attached to the cartridge attachment section 110. Based on the change in detection signal outputted from the optical sensor 114 from low to high, the controller of the printer 10 determines that the amount of ink in the ink chamber 36 is reduced.

In the process of the ink cartridge 30 and the adaptor 160 being inserted into the cartridge attachment section 110, the ink supply portion 34 exposed to an outside through the hole 169 of the adaptor 160 is brought into contact with the retaining portion 121, and the ink needle 122 enters into the ink supply port 71 of the ink supply portion 34. When the ink needle 122 contacts the ink supply valve 70 as the ink needle 122 enters into the ink supply port 71 and the ink cartridge 30 and the adaptor 160 are further moved forward, the ink supply valve 70 is pushed by the ink needle 122 and separated from the ink supply port 71, as illustrated in FIGS. 6 through 8. As the distal end of the ink needle 122 advances into the ink channel 72 in this way, ink in the ink chamber 36 flows into the ink needle 122 through the ink channel 72.

In the process of the ink cartridge 30 and the adaptor 160 being attached to the cartridge attachment section 110 (attachment process), each of the electrodes 75 mounted on the IC board 74 overlaps the corresponding contact 106 of the cartridge attachment section 110 in the upward direction 51 and the downward direction 52, as viewed from a front side thereof. During the attachment process, the IC board 74 disposed on the top wall 164 of the adaptor body 161 of the adaptor 160 resiliently deforms the contacts 106 so as to press the electric contact 106 upward. In the attached state of the ink cartridge 30 and the adaptor 160, the contacts 106 are urged downward by their resilient restoring force, thereby electrically contacting the corresponding electrodes 75 (i.e., the HOT electrode, the GND electrode, and the signal electrode) mounted on the IC board 74 disposed on the top wall 164 of the adaptor body 161. Information retrieved from the IC board 74 is used to determine a color of ink stored in the ink cartridge 30 and a manufacturer of the ink cartridge 30. A color of ink and a manufacturer of the ink cartridge 30 can be determined by a method conventionally known in the art. Therefore, the determination method will not be described here in detail.

In order to remove the ink cartridge 30 from the cartridge attachment section 110, the user pivotally moves the ink cartridge 30 about the front portion thereof, moving the rear portion of the ink cartridge 30 downward, similar to the process of the ink cartridge 30 being inserted into the cartridge attachment section 110. The protrusion 171 thus moves downward to a position below the lock pin 117. Hence, the rear surface 172 of the protrusion 171 is disengaged from the lock pin 117, thereby moving the ink cartridge 30 in the removal direction 58 (i.e. rearward direction 54) by the urging force of the coil spring 73.

That is, while the ink cartridge 30 is attached to the cartridge attachment section 110 together with the adaptor 160, the protrusion 171 can move, in accordance with pivotal movement of the ink cartridge 30 relative to the adaptor 160, to a position where the ink cartridge 30 can be disengaged from the cartridge attachment section 110.

The protrusion 171 at the position where the ink cartridge 30 can be disengaged from the cartridge attachment section 110 allows the ink cartridge 30 to move in the removal direction 58, whereby the ink needle 122 is retracted from the ink supply portion 34. Further, the indicator housing 33 moves further rearward than the optical sensor 114. The detection signal outputted from the optical sensor 114 therefore changes.

Even when the ink cartridge 30 is pivotally moved and removed from the cartridge attachment section 110 as described above, the adaptor 160 remains attached to the cartridge attachment section 110. When another ink cartridge 30 is attached to the cartridge attachment section 110 thereafter, only the ink cartridge 30 is inserted into the cartridge attachment section 110 to which the adaptor 160 remains attached.

Incidentally, the adaptor 160 may be engaged with the ink cartridge 30 by a well-known method, such as fitting. Further, the adaptor 160 may be removed from the cartridge attachment section 110 together with the ink cartridge 30 when the ink cartridge 30 is removed from the cartridge attachment section 110.

In order to remove the adaptor 160 from the cartridge attachment section 110 to which the ink cartridge 30 is not attached, the user moves the adaptor body 161 of the adaptor 160 rearward. At this time, a force exerted on the adaptor body 161 by the user for moving the adaptor body 161 rearward elastically deforms the convex 180 upward. The convex 180 is thus disengaged from the concave 123 formed in the cartridge attachment section 110. In this way, the adaptor 160 can be removed from the cartridge attachment section 110.

That is, the convex 180 can be moved to a position where the adaptor 160 can be disengaged from the cartridge attachment section 110 as the adaptor 160 moves in the removal direction 58 opposite to the insertion direction 57 (i.e. rearward) from a position where the adaptor 160 is completely attached to the cartridge attachment section 110. In other words, a moving direction of the adaptor 160 (i.e. rearward direction 54) for disengaging the convex 180 from the cartridge attachment section 110 differs from a moving direction (i.e. pivotally moving direction) of the ink cartridge 30 for disengaging the protrusion 171 from the cartridge attachment section 110.

<Operational Advantages>

According to the above-described embodiment, the ink cartridge 30 is inserted into the cartridge attachment section 110 together with the adaptor 160 when used. The ink cartridge 30 is removed from the cartridge attachment section 110 when ink stored in the ink cartridge 30 has been consumed. Then, a new ink cartridge 30 is inserted into the cartridge attachment section 110. When the used ink cartridge 30 is removed from the cartridge attachment section 110, the adaptor 160 may remain in the cartridge attachment section 110, or alternatively, may be removed together with the ink cartridge 30 from the cartridge attachment section 110.

The ink cartridge 30 is fixed in position relative to the cartridge attachment section 110 by means of engagement between the protrusion 171 and the cartridge attachment section 110 (the lock pin 117). This enhances the precision of positioning the remaining-amount detection portion (the indicator 62 and the indicator housing 33) relative to the optical sensor 114. Further, since only the ink cartridge 30 is removed from the cartridge attachment section 110 while the adaptor 160 remains attached to the cartridge attachment section 110, the IC board 74 provided at the adaptor 160 does not slide over the contacts 106, thereby suppressing produce of shavings.

According to the above-described embodiment, the ink cartridge 30 can be attached to and removed from the cartridge attachment section 110 by a simple operation of pivotally moving the ink cartridge 30 relative to the cartridge attachment section 110.

Further, according to the above-described embodiment, the protrusion 171 is disposed at the top surface 39 of the casing 31. Hence, a space formed in the cartridge attachment section 110 for accommodating the ink cartridge 30 can have a reduced-size width, compared with a case where the protrusion 171 is disposed on the right surface 37 or the left surface 38.

Still further, according to the above-described embodiment, the indicator housing 33 is positioned further upward than the ink supply portion 34 when the ink cartridge 30 is at the insertion posture. This configuration can prevent the indicator housing 33 from being contaminated by ink. Further, the indicator housing 33 is not covered by the adaptor body 161 of the adaptor 160 and exposed to an outside. Therefore, the adaptor body 161 of the adaptor 160 can have a size almost the same as that of the casing 31 of the ink cartridge 30.

According to the above-described embodiment, a locus of the indicator housing 33 when only the ink cartridge 30 is removed from the cartridge attachment section 110 is unlikely to interfere with the lock pin 117 that engages with the protrusion 171.

According to the above-described embodiment, the protrusion 171, the indicator housing 33, and the light attenuation portion 43 are positioned above the casing 31 when the ink cartridge 30 and the adaptor 160 are at their insertion postures. This configuration allows parts and components of the cartridge attachment section 110 that access the protrusion 171, the indicator housing 33, and the light attenuation portion 43 to be arranged at an upper portion of the cartridge attachment section 110.

Further, according to the above-described embodiment, the light attenuation portion 43 is positioned further forward than the indicator housing 33. Therefore, when the ink cartridge 30 is removed from the cartridge attachment section 110, the indicator housing 33 is unlikely to interfere with the light attenuation portion 43.

Further, according to the above-described embodiment, a direction of disengaging the adaptor 160 from the cartridge attachment section 110 differs from a direction of disengaging the ink cartridge 30 from the cartridge attachment section 110. Hence, erroneous operations when disengaging the adaptor 160 or the ink cartridge 30 from the cartridge attachment section 110 can be avoided.

<First Modification>

Next, an ink cartridge 230 as a printing-fluid cartridge according to a first modification to the embodiment will be described with reference to FIG. 9, wherein like parts and components are designated by the same reference numerals as those of the above-described embodiment to avoid duplicating description.

The ink cartridge 30 according to the above-described embodiment is provided with the protrusion 171. However, in place of the protrusion 171, the ink cartridge 230 is provided with a lever 90 and a leaf spring 91. The lever 90 is pivotally movable relative to the casing 31 and urged upward by the leaf spring 91.

Figure 9:
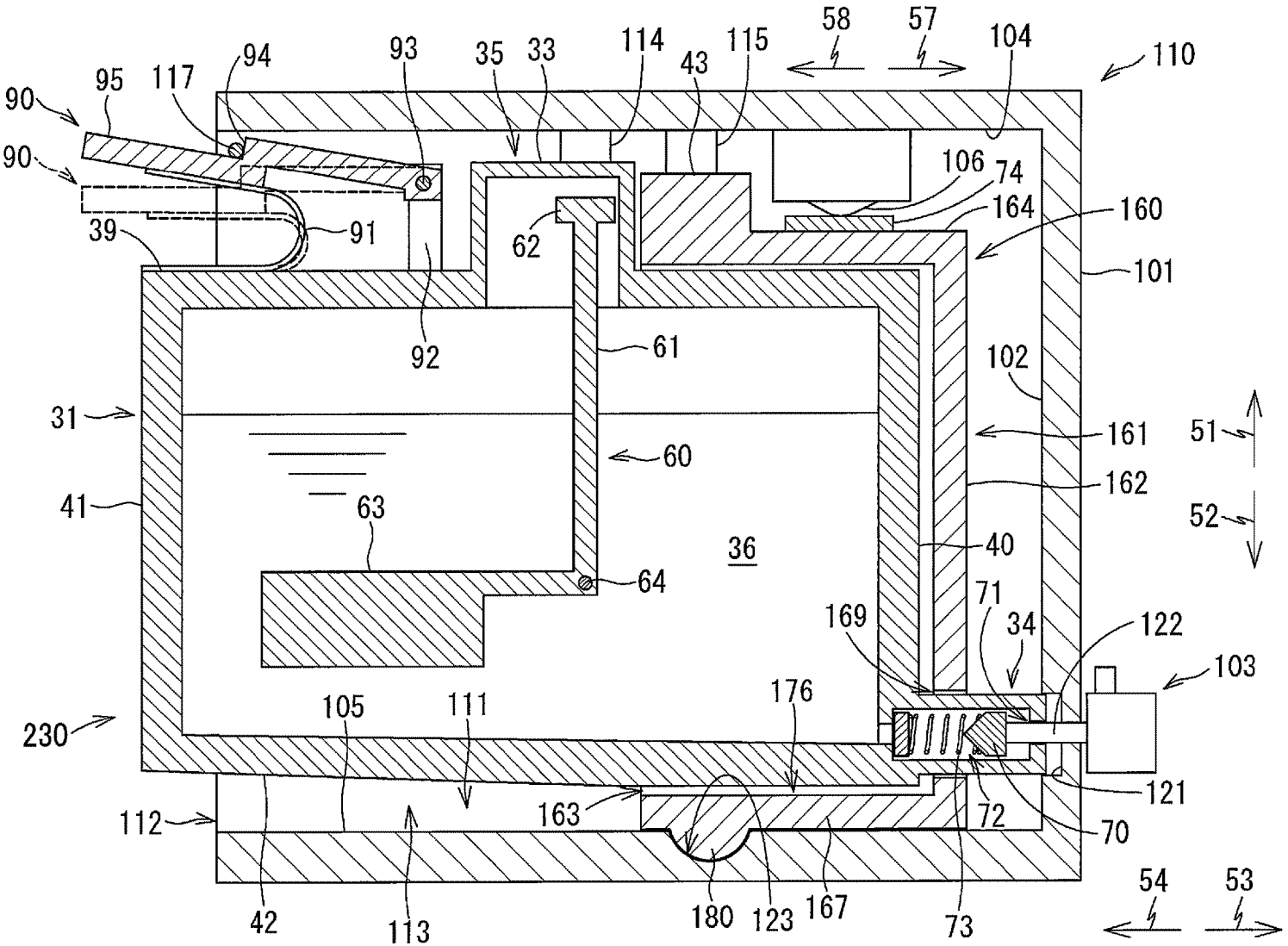
FIG. 9 is a cross-sectional view of the cartridge attachment section 110, an ink cartridge 230, and the adaptor 160, in which the ink cartridge 230 and the adaptor 160 have been attached to the cartridge attachment section 110 according to a modification to the embodiment.

As illustrated in FIG. 9, a support portion 92 is provided at the casing 31. More specifically, the support portion 92 protrudes upward from the top surface 39. A pivot shaft 93 is provided at a top end portion of the support portion 92, extending in the leftward direction 55 and the rightward direction 56. The lever 90 is supported by the pivot shaft 93 so as to be pivotally movable relative to the casing 31.

At the top surface 39, the lever 90 extends diagonally above and rearward from a position rearward of the indicator housing 33. The lever 90 has a generally flat-plate shape having a stepped engagement surface 94 (an example of an engagement portion). The engagement surface 94 extends downward at a middle portion of the lever 90 in the forward direction 53 and the rearward direction 54. Similarly to the rear surface 172 of the protrusion 171 of the ink cartridge 30, the engagement surface 94 is engageable with the lock pin 117 of the cartridge attachment section 110. The lever 90 has an operation portion 95 at a distal end portion (i.e. rear end portion) thereof. The operation portion 95 is a portion of the lever 90 positioned furthest upward from the top surface 39 of the casing 31. Further, the operation portion 95 is positioned further rearward than the rear surface 41 of the casing 31.

The leaf spring 91 is disposed between the lever 90 and the top surface 39 of the casing 31. The leaf spring 91 urges the lever 90 upward, that is, clockwise in FIG. 9. Incidentally, the leaf spring 91 may contact at least one of the lever 90 and the casing 31 in its natural state where no external force is exerted on the leaf spring 91. Pivotal movement of the lever 90 in the upward direction 51 is restricted upon contact of the lever 90 with the support portion 92. FIG. 9 illustrates a state of the lever 90 in a solid line when the lever 90 is pivotally moved furthest upward. A position of the lever 90 indicated by the solid line in FIG. 9 will be referred to as a first position. When the lever 90 is at the first position, the engagement surface 94 is provided at a height substantially the same as a height of the lock pin 117. Hence, the engagement surface 94 is engageable with the lock pin 117. When the user operates the lever 90 to press the operation portion 95 downward, the lever 90 is pivotally moved downward against an urging force of the leaf spring 91, thereby moving the engagement surface 94 and the operation portion 95 to positions closer to the top surface 39 of the casing 31. A position of the lever 90 at this time will be referred to as a second position. In FIG. 9, the lever 90 at the second position is indicated by a dashed line. When the lever 90 is at the second position, the engagement surface 94 is positioned further downward than the lock pin 117. Hence, when the lever 90 is pivotally moved to the second position, the ink cartridge 30 can be inserted into and removed from the cartridge attachment section 110 without interference of the lock pin 117.

In the embodiment described above, the ink cartridge 30 is required to be pivotally moved to engage the rear surface 172 of the protrusion 171 with the lock pin 117 in order to completely attach the ink cartridge 30 to the cartridge attachment section 110. However, according to the first modification, the user only has to pivotally move the lever 90 to engage the engagement surface 94 with the lock pin 117 as illustrated in FIG. 9 in order to completely attach the ink cartridge 30 to the cartridge attachment section 110. Hence, the ink cartridge 30 in its entirety need not be pivotally moved.

According to the first modification, engagement of the engagement surface 94 with the lock pin 117 and disengagement of the engagement surface 94 from the lock pin 117 can be achieved by pivotal movement of the lever 90. Therefore, a space in the cartridge attachment section 110 for moving the engagement surface 94 can be reduced to a size in conformance with the size of the lever 90.

<Other Modifications>

In the above-described embodiment and the first modification, the IC board 74 and the light attenuation portion 43 are disposed at the top surface of the top wall 164 of the adaptor body 161. However, the IC board 74 and the light attenuation portion 43 may be disposed at a surface of the adaptor body 161 other than the top surface, for example, a right surface of the right wall 165.

In the above-described embodiment and the first modification, the protrusion 171, the lever 90, and the indicator housing 33 are disposed at the top surface 39 of the casing 31 of the ink cartridge 30. Alternatively, the protrusion 171, the lever 90, and the indicator housing 33 may be disposed at a surface of the casing 31 other than the top surface 39, for example, the right surface 37.

In the above-described embodiment and the above-described modifications, the ink cartridge 30 is provided with the indicator housing 33 while the adaptor 160 is provided with the light attenuation portion 43. However, the light attenuation portion 43 may be provided at the ink cartridge 30 as far as the light attenuation portion 43 is formed in a material that can block or attenuate light emitted from the optical sensor 115. Further, the indicator housing 33 may not be provided in the ink cartridge 30.

While the description has been made in detail with reference to the embodiment thereof, it would be apparent to those skilled in the art that various changes and modifications may be made therein without departing from the scope of the disclosure.

What is claimed is:

1. A printing-fluid containing device configured to be detachably attached to a cartridge attachment section, the printing-fluid containing device comprising:

a cartridge configured to store printing-fluid therein; and a top wall configured to be detachably mounted on the cartridge, the top wall being positioned above the cartridge in a state where the top wall is mounted on the cartridge, the printing-fluid containing device having the top wall mounted on the cartridge being detachably attached to the cartridge attachment section, wherein the cartridges comprises:

a casing including a chamber configured to store printing-fluid therein, the casing having a front surface and a rear surface opposite the front surface, the front surface being apart from the rear surface in a frontward direction and facing in the frontward direction, the rear surface facing in a rearward direction opposite to the frontward direction, the chamber being disposed between the front surface and the rear surface;

a supply portion disposed at the front surface of the casing and extending in the frontward direction away from the rear surface such that a front end of the supply portion is further frontward of the front surface of the casing, the supply portion being configured to flow the liquid from the chamber in the frontward direction;

an engagement portion provided at the casing and configured to be engaged with the cartridge attachment section in the state where the printing-fluid containing device having the top wall mounted on the cartridge is attached to the cartridge attachment section; and a liquid detection portion provided at the casing and including a light accessible portion configured to be accessed by light emitted from an outside of the printing-fluid containing device, wherein the top wall is provided with an electric interface which is electrically connectable to an electric contact provided at the cartridge attachment section in the state where the printing-fluid containing device having the top wall mounted on the cartridge is attached to the cartridge attachment section, and wherein in the state where the top wall is mounted on the cartridge, the top wall is positioned further upward of the supply portion in an upward direction perpendicular to the frontward direction and the electrical interface is positioned further downward of the light accessible portion.

2. The printing-fluid containing device according to claim 1, wherein the casing further has an upper surface disposed between the front surface and the rear surface in the frontward direction and disposed further upward of the supply portion, the upper surface facing in the upward direction, wherein the top wall has an upper surface facing in the upward direction and a lower surface facing in a downward direction opposite to the upward direction, the electrical interface being disposed on the upper surface of the top wall, and wherein in the state where the top wall is mounted on the cartridge, the top wall is disposed on the upper surface of the casing such that the lower surface of the top wall faces the upper surface of the casing.

3. The printing-fluid containing device according to claim 2, wherein the top wall is further provided with a light attenuation portion configured to attenuate light emitted from an outside of the printing-fluid containing device, the electrical interface being disposed at the upper surface of the top wall, an upper end of the light attenuation portion being positioned further upward of the electrical interface, wherein the light attenuation portion is disposed between the liquid detection portion and the electrical interface in the frontward direction in the state where the top wall is mounted on the cartridge, wherein the top wall has a front end and a rear end opposite to the front end in the frontward direction, the light attenuation portion being disposed at a position closer to the rear end of the top wall than to the front end of the top wall in the frontward direction.

4. The printing-fluid containing device according to claim 3, wherein the light attenuation portion extends from the upper surface of the top wall in the upward direction.

5. The printing-fluid containing device according to claim 2, wherein the cartridge further comprise an urging member configured to urge the casing in the rearward direction.

6. The printing-fluid containing device according to claim 2, wherein the engagement portion includes a leaf spring.

7. The printing-fluid containing device according to claim 6, wherein the leaf spring is disposed on the upper surface of the casing.

8. The printing-fluid containing device according to claim 2, wherein the engagement portion protrudes from the upper surface of the casing in the upward direction.

9. The printing-fluid containing device according to claim 2, wherein the light accessible portion includes an indicator configured to change its position relative to the casing in accordance with change in an amount of the printing-fluid stored in the chamber from a first position at which the indicator attenuates the light for detection emitted from the outside to a second position at which the indicator is positioned offset from a path of the light for detection.

10. The printing-fluid containing device according to claim 3, wherein the light attenuation portion has a front edge and a rear edge opposite to the front edge in the frontward direction, and wherein a width of the rear edge of the light attenuation portion is smaller than a width of the liquid detection portion, the width of the rear edge of the light attenuation portion and the width of the liquid detection portion being defined in a direction perpendicular to both of the frontward direction and the upward direction.

11. A printing-fluid containing device configured to be detachably attached to a cartridge attachment section, the printing-fluid containing device comprising:

a cartridge configured to store printing-fluid therein; and a top wall configured to be detachably mounted on the cartridge, the top wall being positioned above the cartridge in a state where the top wall is mounted on the cartridge, the printing-fluid containing device having the top wall mounted on the cartridge being detachably attached to the cartridge attachment section, wherein the cartridge comprises:

a casing including a chamber configured to store printing-fluid therein, the casing having a front surface and a rear surface opposite the front surface, the front surface being apart from the rear surface in a frontward direction and facing in the forward direction, the rear surface facing in a rearward direction opposite to the frontward direction, the chamber being disposed between the front surface and the rear surface, the casing further having an upper surface disposed between the front surface and the rear surface in the frontward direction, the upper surface being disposed further upward of the chamber in an upward direction perpendicular to the frontward direction and facing in the upward direction;

a supply portion disposed at the front surface of the casing and extending in the frontward direction away from the rear surface such that a front end of the supply portion is further frontward of the front surface of the casing, the supply portion being disposed further downward of the upper surface in a downward direction opposite to the upward direction, the supply portion being configured to flow the liquid from the chamber in the frontward direction;

an engagement portion provided at the casing and configured to be engaged with the cartridge attachment section in the state where the printing-fluid containing device having the top wall mounted on the cartridge is attached to the cartridge attachment section, the engagement portion including a leaf spring; and a liquid detection portion provided at the casing and including a light accessible portion configured to be accessed by light emitted from an outside of the printing-fluid containing device, wherein the top wall has an upper surface facing in the upward direction and a lower surface facing in a downward direction opposite to the upward direction, the top wall is disposed on the upper surface of the casing such that the lower surface of the top wall faces the upper surface of the casing in the state where the top wall is mounted on the cartridge, wherein the top wall is provided with:

an electrical interface disposed on the upper surface of the top wall, the electrical interface being electrically connectable to an electric contact provided at the cartridge attachment section in the state wherein the printing-fluid containing device having the top wall mounted on the cartridge is attached to the cartridge attachment section; and a light attenuation portion positioned at the upper surface of the top wall and configured to attenuate light emitted from an outside of the printing-fluid containing device, the top wall being positioned further upward of the supply portion in the upward direction in the state where the top wall is mounted on the cartridge, the electrical interface being disposed on the upper surface of the top wall such that the electrical interface is positioned further downward of the light accessible portion in the state where the top wall is mounted on the cartridge, an upper end of the light attenuation portion being positioned further upward of the electrical interface, the light attenuation portion being disposed between the liquid detection portion and the electrical interface in the frontward direction in the state where the top wall is mounted on the cartridge, the top wall having a front end and a rear end opposite to the front end in the frontward direction, the light attenuation portion being disposed at a position closer to the rear end of the top wall than to the front end of the top wall in the forward direction.

12. The printing-fluid containing device according to claim 11, wherein the light attenuation portion extends from the upper surface of the top wall in the upward direction.

13. The printing-fluid containing device according to claim 11, wherein the cartridge further comprises an urging member configured to urge the casing in the rearward direction.

14. The printing-fluid containing device according to claim 11, wherein the leaf spring is disposed on the upper surface of the casing.

15. The printing-fluid containing device according to claim 11, wherein the light accessible portion includes an indicator configured to change its position relative to the casing in accordance with change in an amount of the printing-fluid stored in the chamber from a first position at which the indicator attenuates the light for detection emitted from the outside to a second position at which the indicator is positioned offset from a path of the light for detection.

16. The printing-fluid containing device according to claim 1, further comprising an adaptor detachably attachable with the cartridge, the adaptor having the top wall.

* * * * *